US005507753A

United States Patent [19]

Iwasaki et al.

[11] Patent Number: 5,507,753

[45] Date of Patent: Apr. 16, 1996

[54] DEPILATING DEVICE WITH SKIN GUIDE STRETCHER

[75] Inventors: Jyuzaemon Iwasaki, Nagahama; Masao Tanahashi; Hidekazu Sueyoshi, both of Hikone, all of Japan

[73] Assignee: Matsushita Electric Works, Ltd., Osaka, Japan

[21] Appl. No.: 231,266

[22] Filed: Apr. 12, 1994

[30] Foreign Application Priority Data

| | | | |
|---|---|---|---|
| Apr. 15, 1993 | [JP] | Japan | 5-088956 |
| Jul. 27, 1993 | [JP] | Japan | 5-185269 |
| Dec. 22, 1993 | [JP] | Japan | 5-325449 |

[51] Int. Cl.[6] ..... A45D 26/00

[52] U.S. Cl. ..... 606/133; 606/131

[58] Field of Search ..... 606/131, 133; 452/75, 102, 104; 36/34.2

[56] References Cited

U.S. PATENT DOCUMENTS

| | | |
|---|---|---|
| 2,952,907 | 9/1960 | Miller . |
| 3,644,991 | 2/1972 | Kobler . |
| 5,108,410 | 4/1992 | Iwasaki et al. . |

FOREIGN PATENT DOCUMENTS

| | | |
|---|---|---|
| 0342546A2 | 11/1989 | European Pat. Off. . |
| 0364321A1 | 4/1990 | European Pat. Off. . |
| 0408095A1 | 1/1991 | European Pat. Off. . |
| 0500075A3 | 8/1992 | European Pat. Off. . |
| 1252899 | 3/1960 | France . |
| 2663520 | 12/1991 | France . |
| 1703736 | 2/1972 | Germany . |

OTHER PUBLICATIONS

Patent Abstracts of Japan, vol. 2, No. 135 (M–039) 1983 & JP–A–53 106 256.

Abstract of Japanese Publication No. JP5003806, dated Jan. 14, 1993.

*Primary Examiner*—Stephen C. Pellegrino
*Assistant Examiner*—Glenn Dawson
*Attorney, Agent, or Firm*—Nikaido, Marmelstein, Murray & Oram

[57] ABSTRACT

A depilating device has a housing with a top opening and a plucking head with a longitudinal axis. The plucking head carries a series of pinching elements arranged in side-by-side relations to form therebetween gaps. At least one of the adjacent pinching elements is movable relative to the other so as to entrap and pinch the hairs between the adjacent pinching elements for plucking the hairs from the skin. A skin guide is disposed around the plucking head to be exposed at least partially beyond the pinching elements for sliding contact with the skin. The plucking head and the skin guide are floatingly supported to the housing by means of a common structure such that they are depressed together into the housing within a predetermined extent.

27 Claims, 28 Drawing Sheets

37
40
34
30
34
20
35
36
18

13
28
10

15
18
78
19
95
94
90
90
83
80
81
64
82
97
93
60
68
66
65
16
72
110
82
67
17
69
71
100
70
10
14

A
40
245
R
B
223

246
246

A
210
40
220
245
R
B
223

246
246

A
40
245
223
B
R
210
220

246
246

245D
230D
246D
246D
240D
248D 245C
230C
246C
M
246C
L
230C
248C

DEPILATING DEVICE WITH SKIN GUIDE STRETCHER

BACKGROUND OF THE INVENTION

1. Field of the Invention

The present invention is directed to a depilating device for removing superfluous hairs from the skin for aesthetic reasons or the like.

2. Description of the Prior Art

Depilating devices are known, for example, in European Patent Publication EP 0 500 075 A2, which has a plucking head having a plurality of pinching elements arranged along an longitudinal axis of the head. At least one of the adjacent pinching elements is driven to move towards and away from the other pinching elements so as to repeat pinching the hairs therebetween and releasing the hairs for plucking the hairs from the skin of a user. The prior depilating device discloses the use of a skin guide disposed in an adjacent relation to a plucking head. The skin guide is in use pressed against the skin of a user in order to pluck the hairs by the plucking head while pressing the skin, whereby reducing pain in plucking the hairs. In addition, the skin guide acts to stretch the skin prior to plucking the hairs while guided in contact with the skin in an attempt to further reducing the pain. The skin guide is resiliently supported to a depilator housing so that it is pressed against the skin by a suitable pressing force. The plucking head is also floatingly supported to the housing for intimate contact with the skin by a suitable pressing force applied from the user. However, the skin guide and the plucking head are separately supported to the housing by different mechanisms so that they are depressed independently from each other with different counterforces. With this separate supporting structure, the plucking head and the skin guide are likely to be pressed at different forces depending upon the portions of the skin depending upon a manner of pressing the plucking head against the skin or a pressing force applied to the skin from the user, which may cause the plucking head to be pressed by a greater force than the skin guide. In this case, the plucking head suffers from an overload condition where the movable pinching element of the head lowers its operation speed or the plucking rate, failing to pluck the hair quickly and therefore irritating the skin.

SUMMARY OF THE INVENTION

The present invention has been accomplished to eliminate the above problem and provide an improved depilating device which can effectively minimize pain in plucking the hairs to assure a comfortable use. The depilating device of the present invention comprises a housing with a top opening and a plucking head with a longitudinal axis. The plucking head carries a series of pinching elements arranged in side-by-side relations to form therebetween gaps. At least one of the adjacent pinching elements is movable relative to the other in a direction of successively opening and closing said gaps so as to entrap and pinch the hairs between the adjacent pinching elements for plucking the hairs from the skin. The plucking head is disposed to expose the pinching elements in the top opening. An electric motor is incorporated within the housing and connected through a drive mechanism to drive the plucking head for plucking the hairs. A skin guide is disposed around the plucking head within the opening to be exposed at least partially beyond the pinching elements for sliding contact with the skin. The device is characterized in that the plucking head and the skin guide are floatingly supported to the housing by means of a common structure such that they are capable of being depressed together into the housing within a predetermined extent. With this common supporting structure, the plucking head and the skin guide can be depressed to the same extent, i.e, pressed evenly against the skin. Whereby, the skin guide can well prevent the plucking head from being over-pressed against the skin, which avoids the otherwise lowering of the plucking speed, thus assuring effective plucking operation without irritating the skin.

Accordingly, it is a primary object of the present invention to provide an improved depilating device which is capable of plucking the hairs efficiently and comfortably.

In a preferred embodiment, the plucking head is mounted together with the skin guide, the motor, and the driving mechanism to a chassis which is accommodated within the housing and is floatingly supported thereto by a spring. Thus, a large number of components can be mounted into the chassis and therefore assembled into a unitary structure for easy fabrication of the device, in addition to that only the spring is enough to floatingly support the plucking head and the skin guide, which is therefore another object of the present invention.

The skin guide is formed with a stretcher rib which engages the skin for stretching the skin as manipulating the device to advance the skin guide in one direction in contact with the skin. Thus, the hair plucking can be made with the skin being stretched for facilitating the removal of the hairs therefrom and therefore minimize pain in plucking the hairs, which is therefore a further object of the present invention.

The skin guide is made pivotally relative to the housing about a pivot axis extending along the longitudinal axis of the plucking head so that the skin guide can easily follow the contours of the skin for facilitating the hair plucking, which is therefore a still further object of the present invention.

Preferably, the device includes a pair of the skin guides which are spaced along the longitudinal axis of the plucking head and located in an adjacent relation longitudinally outwardly of opposed ends of the plucking head. The skin guides are made integral with each other and act to press the opposed portions of the skin between which portions the hairs are plucked. Thus, the hair guides are kept pressed in a constant and effective relation with the plucking head for facilitating to pluck the hairs.

The present invention further discloses a variety of advantageous configurations of the skin guide or stretcher ribs for keeping the skin stretched while plucking the hairs therefrom for assuring pain-less and comfortable hair plucking.

These and still other objects and advantageous features will become more apparent from the following description of the preferred embodiments when taken in conjunction with the attached drawings.

DETAILED DESCRIPTION OF THE PREFERRED EMBODIMENTS

First Embodiment <FIGS. 1 to 19B>

Figure 1:
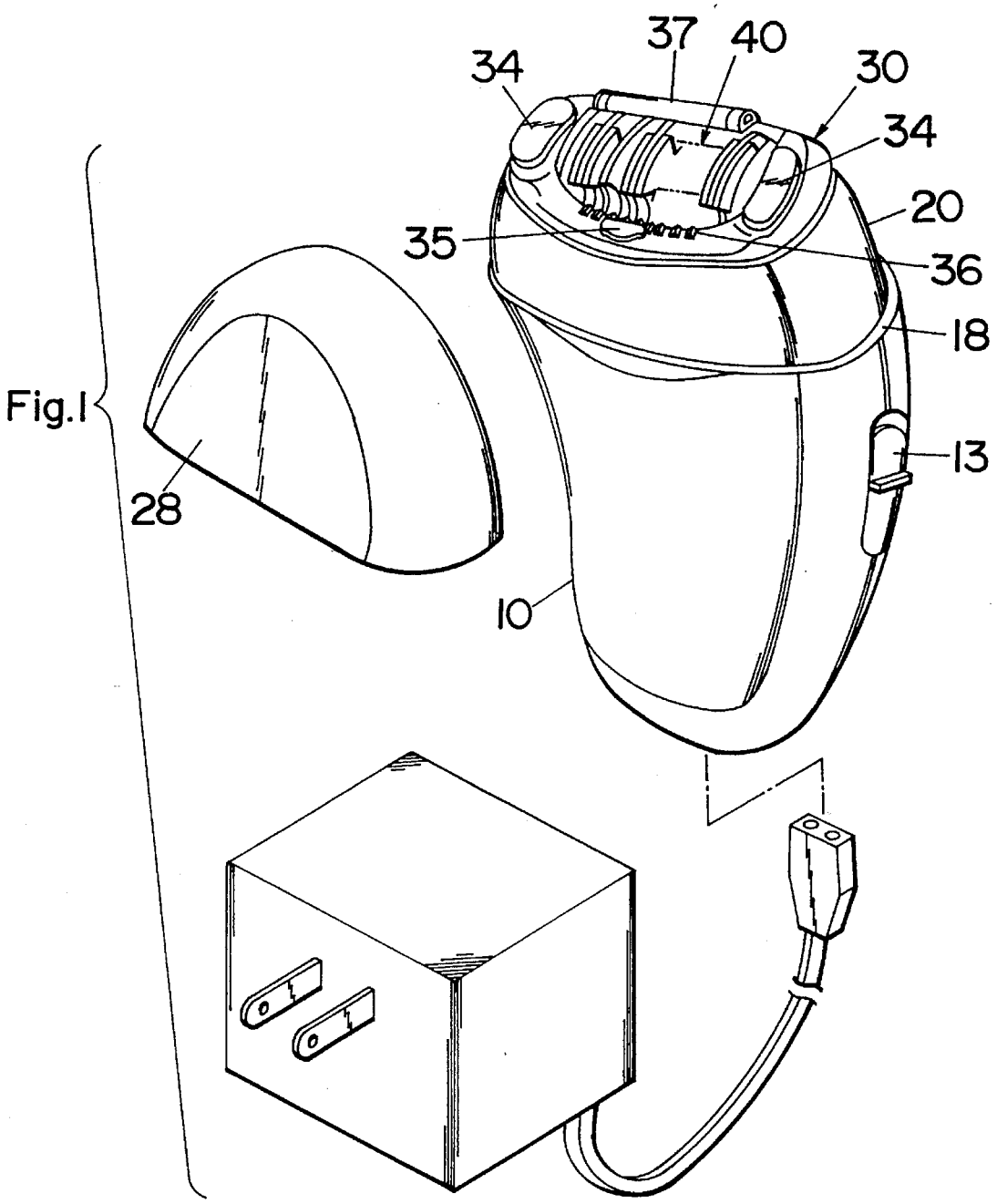
FIG. 1 is a perspective view of a depilating device in accordance with a first embodiment of the present invention.
Figure 2:
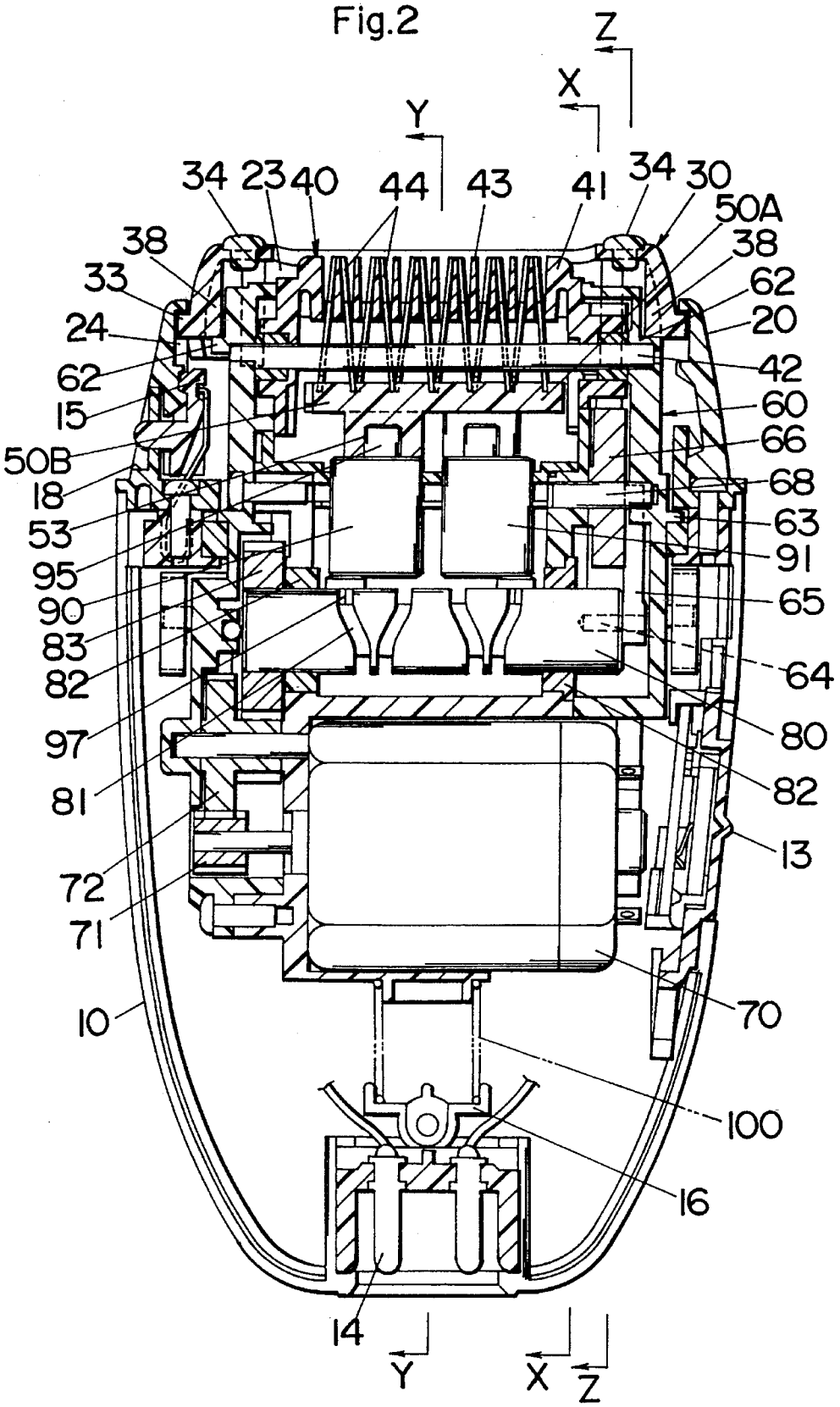
FIG. 2 is a vertical section of the device.
Figure 3:
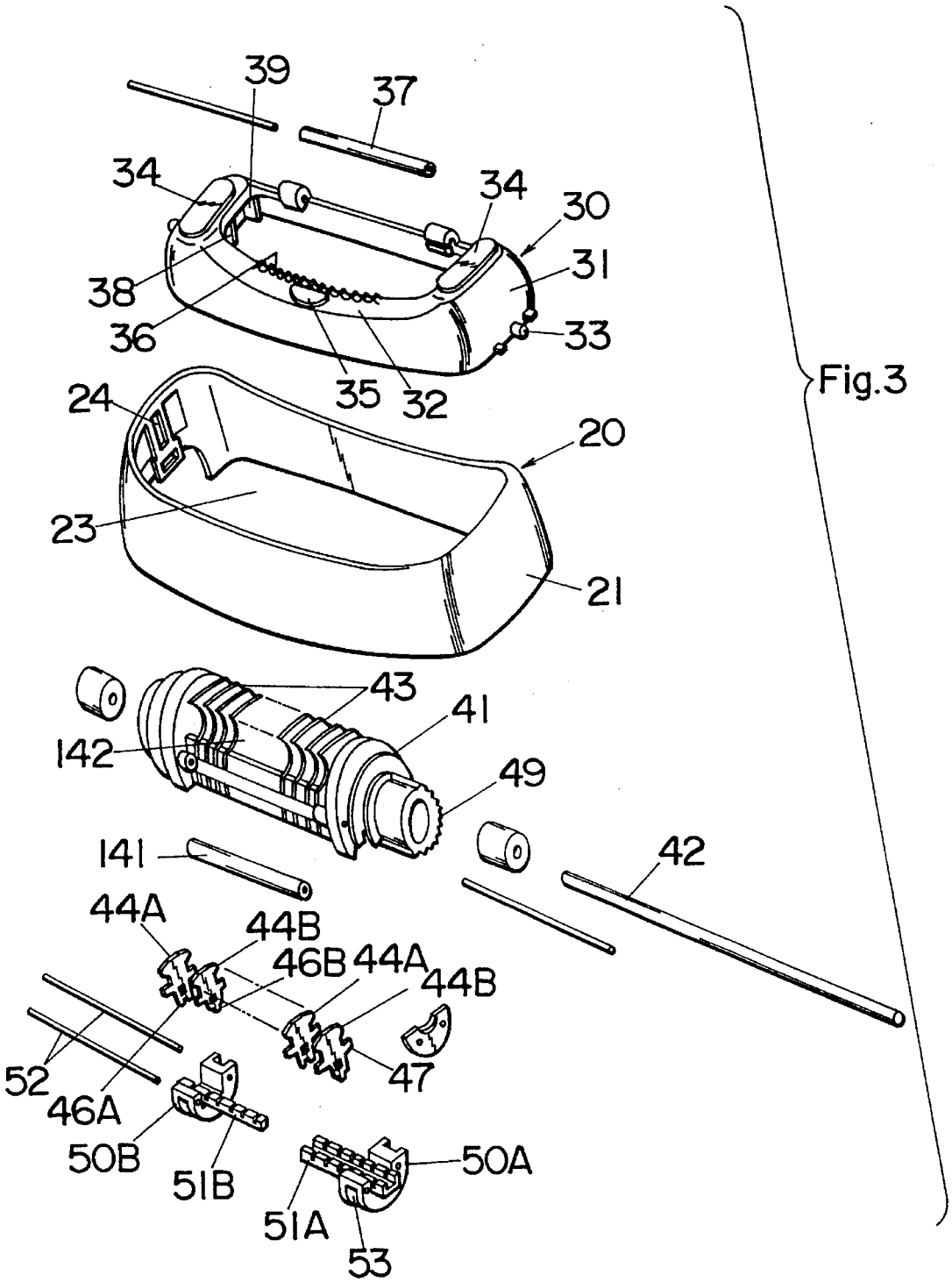
FIG. 3 is an exploded perspective view of an upper portion of the device.
Figure 4:
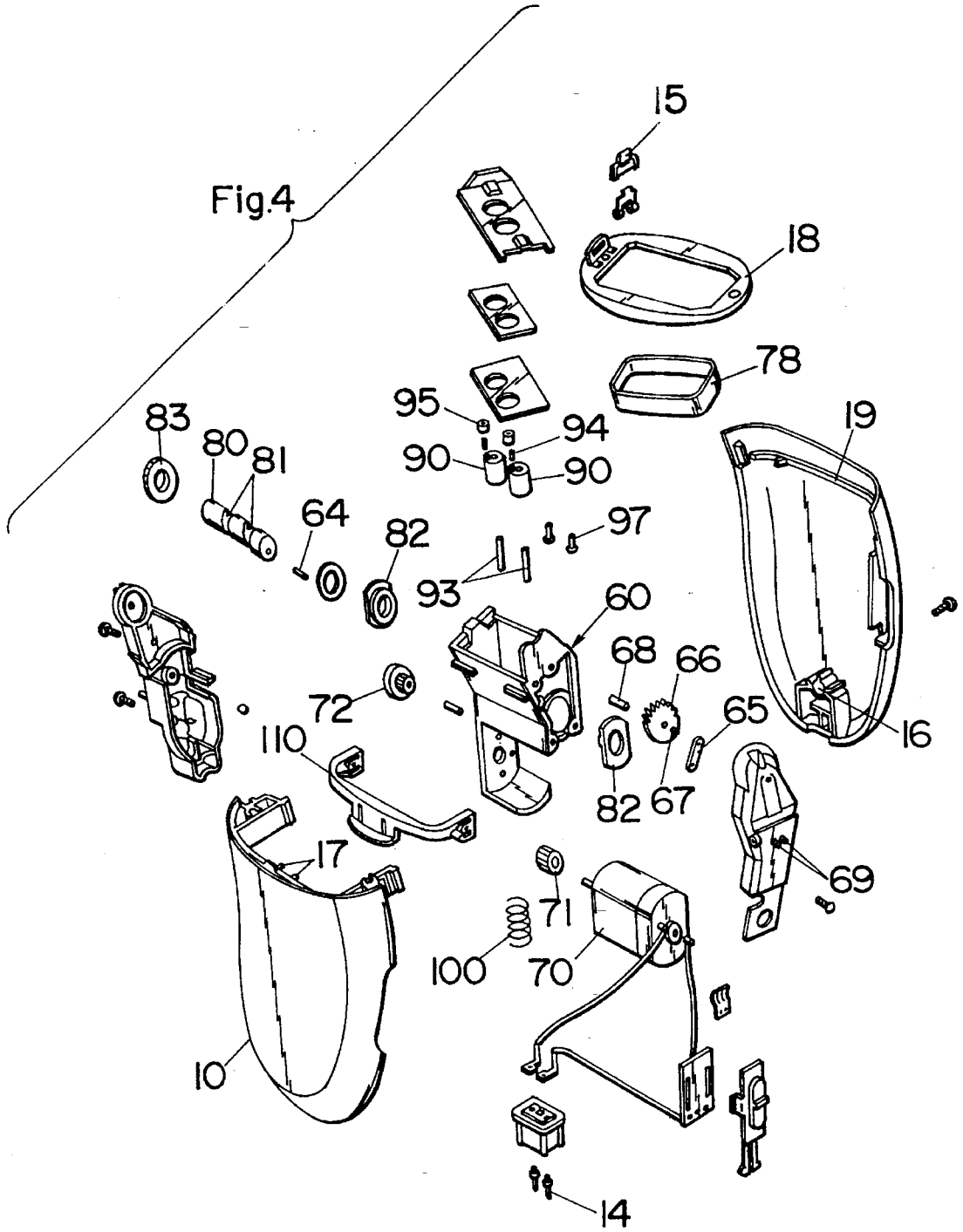
FIG. 4 is an exploded perspective view of a lower portion of the device.

Referring to FIG. 1, there is shown a depilating device in accordance with a first embodiment of the present invention. The device comprises a housing 10 mounting a head frame 20 with a generally rectangular opening 23 and a plucking head 40 disposed within the head frame 20 to be exposed through the opening. As shown in FIGS. 2 to 4, the housing 10 incorporates a chassis 60 mounting a motor 70, a positive return cam 80, and a drive mechanism for the plucking head 40. The housing 10 is provided with a power switch 13 for turning on and off the motor 70 and also with a pair of terminal pins 14 for electrical connection to an AC power adaptor to energize the motor 70. As best shown in FIG. 3, the head frame 20 is in the form of a top and bottom opened rectangular frame having a pair of end walls 21 between which the plucking head 40 is received. The head frame 20 is detachably mounted on the upper end of the housing 10 by means of a hook 15 and carries a skin guide frame 30 which comes into contact with the skin of the user for guiding the plucking head 40 across the skin. The hook 15 is provided on a base plate 18 secured to the housing 10. A head cap 28 is provided to fit over the head frame 20 for protection thereof when not in use.

The plucking head 40 comprises a carrier 41 rotatably supported about a shaft 42 which extends horizontally between the upper ends of the chassis 60 to define a longitudinal axis of the plucking head. The carrier 41 is formed with a series of fixed pinching plates 43 of an arcuate configuration arranged along the longitudinal axis. The fixed pinching plates 43 are made of a plastic material having some elasticity and are molded integrally with the carrier 41 to provide a unitary structure. Mounted on the carrier 41 are movable pinching plates 44 which are arranged along the axis of the shaft 42 in an alternating relation to the fixed pinching plates 43. The movable pinching plates 44 are composed of first and second plates 44A and 44B which are commonly supported loosely on the shaft 42 to be rotatable thereabout together with the carrier 41 and the fixed pinching plates 43. The first and second plates 44A and 44B are arranged along the axis of the shaft 42 alternately to each other and are secured at their lower ends respectively to first and second sliders 50A and 50B which are slidably supported by axles 52 held in the lower end of the carrier 41 and which are driven to reciprocate in parallel with the shaft 42 but in the opposite directions to each other, as will be discussed later. The first and second movable pinching plates 44A and 44B are formed at their ends respectively with a pair of spaced anchor legs 46A and a single anchor leg 46B which are press-fitted to corresponding notches 51A and 51B formed in the sliders 50A and 50B, respectively. Each of the movable pinching plates 44A and 44B are also formed to have a pair of side tabs 47 on the opposite sides of a hole 45 through which the shaft 42 extends. The side tabs 47 are press fitted to corresponding grooves formed in the carrier 41, so that the movable pinching plates 44 are allowed to swing about the individual connections of the side tabs 47 with the grooves toward and away from the adjacent fixed pinching plates 43 as the anchor legs 46 are caused to move axially by the reciprocation of the sliders 50A and 50B. Thus, the movable pinching plates 44 are driven to swing or to have the upper edges displaced axially toward and away from the adjacent fixed pinching plates 43 so as to repeat clamping the hairs between the movable and fixed pinching plates 43 and 44 and releasing the hairs for plucking the hairs in association with an oscillatory movement of the carrier 41 about the shaft 42, the detail of which will be discussed later.

Figure 7:
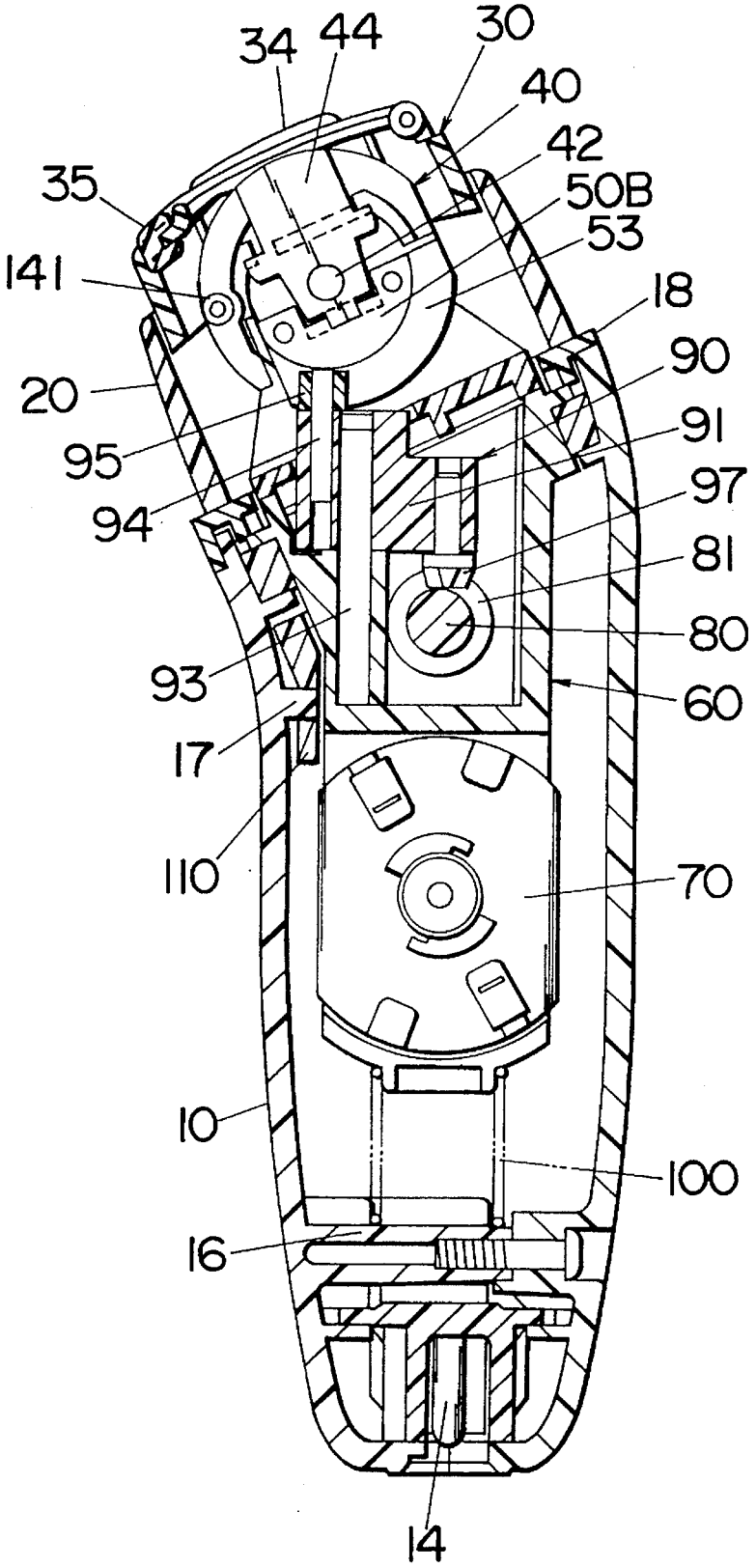
FIG. 7 is a sectional view taken along line Y—Y of FIG. 2.

Referring to FIGS. 2 and 4, the chassis 60 supports, in addition to the motor 70, a positive-return cam 80 and a 10 plurality of gears for establishing a drive connection from the motor 70 to the positive-return cam 80 as well as for oscillating the carrier 41, i.e., the plucking head 40 about the shaft 42. The positive-return cam 80 is provided in the form of a cylinder with a pair of circumferentially extending grooves 81 which are symmetrical to each other such that the horizontal distance between the grooves varies in the circumferential direction. The cam 80 is journaled at its opposed ends by means of bearings 82 in the chassis 60 to be rotatable about a horizonal axis and is operatively connected to the sliders 50A and 50B by means of cam cylinders 90. As best shown in FIGS. 4 and 7, the cam cylinder 90 comprises a barrel 91 supported to the chassis 60 by means of a vertical pin 93 to be rotatably about the pin 93. Projecting upwardly from the barrel 91 is an eccentric pin 94 which is eccentric to the pin 93 and carries a roller 95. The roller 95 is slidably received in an arcuate furrow 53 formed in the bottom of each of the sliders 50A and 50B. The barrel 91 is also provided on its lower end with a cam follower 97 for slidable engagement into each one of grooves 81 of the cam 80 such that the rotation of the cam 80 is translated into reciprocating movement of the sliders 50A and 50B along the shaft 42 through a swinging movement of the cam cylinders 90, thereby displacing the movable pinching plates 44A and 44B in the axial direction to move their upper edge into abutment and away from the associated fixed pinching plates 43.

Thus, the rotation of the cam 80 causes the sliders 50A and 50B to reciprocate along the axis of the shaft 42 in opposite directions, thereby displacing a set of alternate movable pinching plates 44A in the same direction and at the same time displacing the other alternate set of the movable pinching plates 44B in the opposite direction. In this manner, every set of two adjacent movable pinching plates 44A and 44B are caused to swing in the opposing directions to have their upper edges abutted against on both sides of the common fixed pinching plate 43 located between the two adjacent movable pinching plates 44A and 44B in order to clamp the hairs therebetween.

Figure 6:
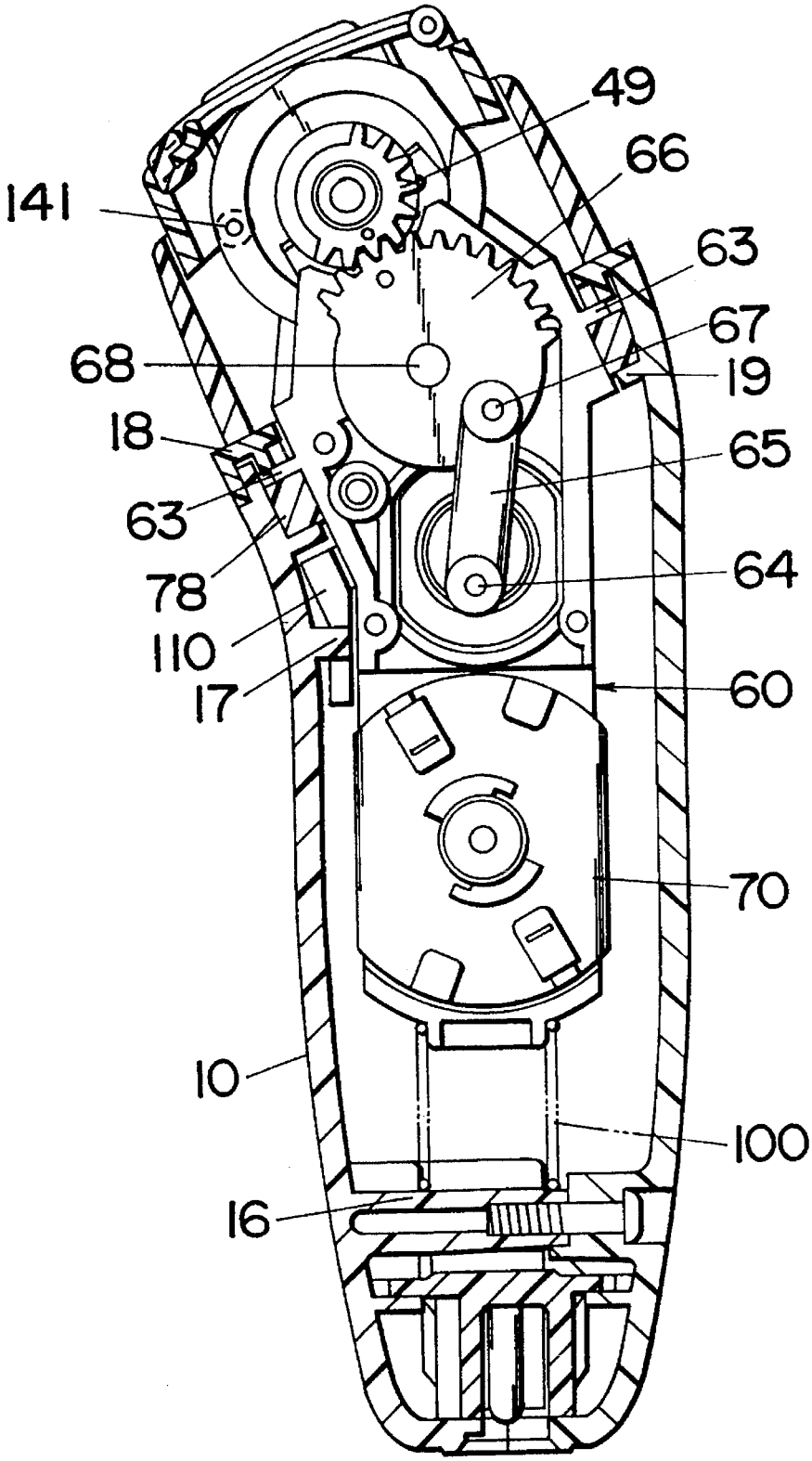
FIG. 6 is a sectional view taken along line X—X of FIG. 2.

The motor 70 is operatively connected to the cam 80 through a reduction gear train of a pinion 71 of the motor 70, a first gear 72 and a second gear 83 fixed on one end of the cam 80. The cam 80 is linked to one end of a crank lever 65 at the end opposite of the second gear 83 by means of an eccentric pin 64 which is eccentric to the horizonal axis of the cam 80, as shown in FIG. 6. The other end of the crank lever 65 is coupled to a partially toothed rack wheel 66 by means of a pivot pin 67 which is eccentric to a shaft 68 carrying the rack wheel 66. The rack wheel 66 is in meshing engagement with a gear 49 on one end of the shaft 42 of the carrier 41 so that the rotation of the eccentric pin 64 about the axis of the cam 80 is translated into an oscillating rotary movement of the rack wheel 66 about the shaft 68 and therefore the corresponding movement of the gear 49 or the plucking head 40 about the shaft 42. That is, the plucking head 40 is caused to oscillate about the shaft 42 in synchronism with the plucking movement of displacing the movable pinching plates 44 in the axial direction of the shaft 42, and is so arranged as to complete one oscillation cycle while the cam 80 rotates one rotation about its horizontal axis such that the movable pinching plate 44 is caused to move toward and away from one of the two adjacent fixed pinching plates 43 during one oscillation cycle of the plucking head 40 about the shaft 42 and to move toward and away from the other fixed pinching plate 43 during subsequent oscillation cycle of the plucking head 40. More detailed operation of the plucking head 40 is explained in the pending U.S. application Ser .No. 836,903 and therefore is omitted herein.

However, it is noted here that the plucking head 40 is driven to oscillate about its longitudinal axis between a limited angular range such that the clamping edges of the pinching plates 44 are caused to advance into the opening 23 and retard inwardly into the head frame 20, during which swinging movement the hairs are plucked as being clamped between the adjacent pinching plates 43 and 44. The plucking head 40 is disposed at the upper end of the head frame 20 together with the guide frame 30 so as to define an advancing direction along which the housing 10 or the guide frame 30 is moved by the user in contact with the skin for successively plucking the hairs over a wide area of the skin. The advancing direction is defined to be perpendicular to the longitudinal axis of the plucking head 40 and correspond to a forward angular movement of the plucking head 40 about its longitudinal axis in which the clamping edges of the pinching plates 44 moves outwardly into the opening 23 about the longitudinal axis for entrapping the hairs between the movable and fixed pinching plates 44 and 43. That is, when moving the guide frame 30 in contact with the skin in the advancing direction, the plucking head 40 will follow that direction as moving forward from the behind in circumferential direction about the longitudinal axis of the plucking head 40. The plucking head 40 is additionally provided with a skin guide roller 41 which extends in parallel with the longitudinal axis of the plucking head and is located forwardly of the pinching plates 44 with respect to a direction of moving the pinching plates into contact with the skin from the inwardly retracted position, such that the roller 141 comes first into contact with the skin for smoothing the skin prior to plucking the hairs therefrom.

Figure 11:
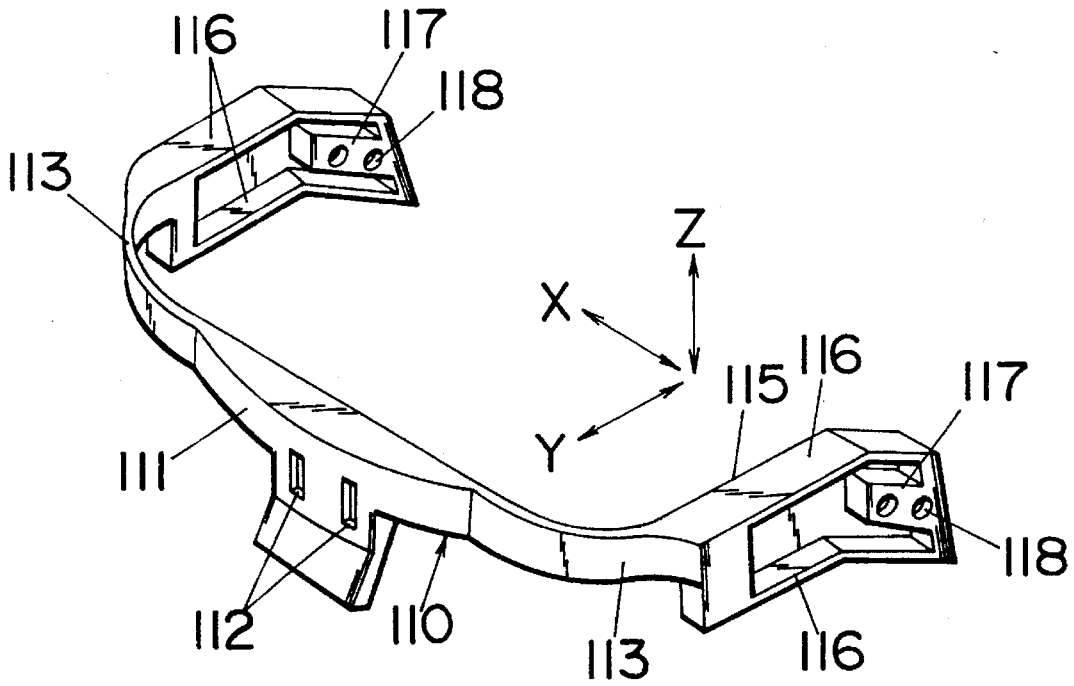
FIG. 11 is a perspective view of a spring harness utilized in the device.
Figure 12A:
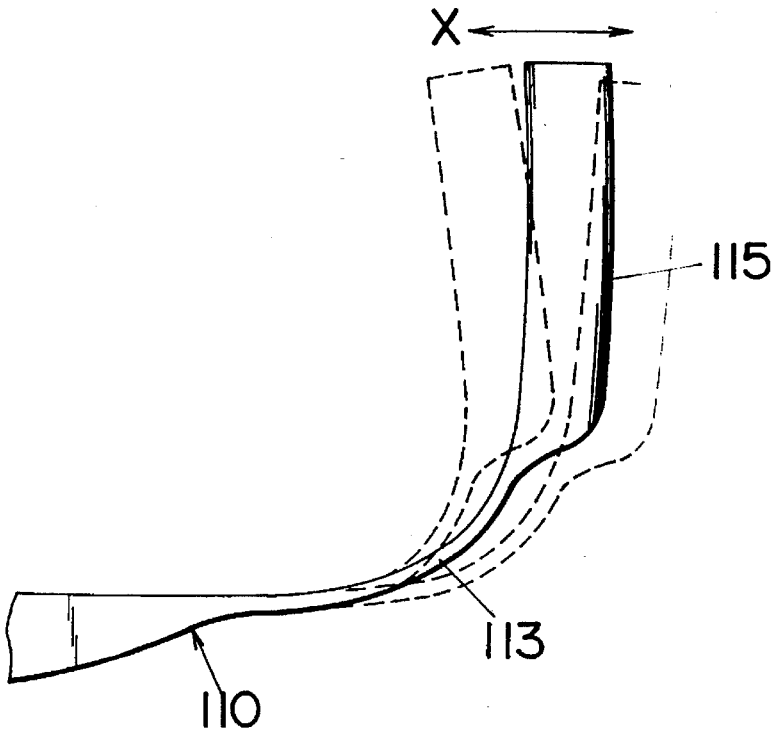
FIGS. 12A and 12B illustrate the behaviors of the harness.
Figure 12B:
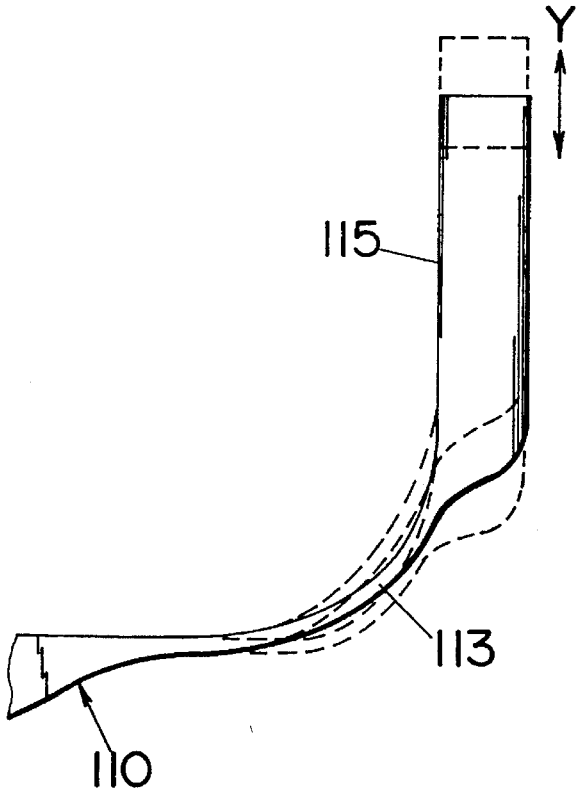

The plucking head 40 is mounted on the chassis 60 together with the motor 70 as well as the other components establishing a driving mechanism therebetween so that almost all of the components are integrated into a unitary structure which is assembled into the housing 10. The chassis 60 is floatingly supported within the housing 10 by means of a coil spring 100 and a spring harness 110 so that the plucking head 40 can be depressed inwardly into the housing 10 to a limited extent and therefore can readily follow the contour of the skin without accompanying an excessive couterforce exerted to the plucking head 40 when pressing the head 40 to the skin. As seen in FIG. 2, the coil spring 100 is interposed between the lower end of the chassis 60 and a stand 16 on the interior of the housing 10. The spring harness 10 is made of a plastic material into a generally U-shaped configuration having a pair of side arms 115 extending from the opposite ends of a band 111. As best shown in FIG. 11, the band 111 is formed in its thick center portion with holes 112 into which corresponding studs 17 on the interior of the housing 10 engage to secure the spring harness 110 to the housing 10. The side arm 115 comprises a pair of thin resilient strips 116 joining at one ends into one rigid portion at the connection to the band and joining at the other ends into a rigid bracket 117 with mount holes 118 so that the side arm 115 is allowed to flex resilient in the vertical direction, i.e., in Z-direction as indicated in FIG. 11. The side arms 115 are secured to the chassis 60 by engagement of bosses 69 on the side of the chassis 60 into the mount holes 118. Thus, the chassis 60 and therefore the plucking head 40 is floatingly supported also by means of the harness 110 to the housing 10. The connection between the side arms 115 and the band 111 are made thin to define thereat resilient corners 113 which permit the side arms 115 or the chassis 60 to flex in X- and Y-directions, as indicated in FIGS. 12A and 12B, to absorb horizonal displacement of the chassis 60 attendant with the vertical displacement thereof, whereby assuring a smooth vertical displacement of the chassis 60 and the plucking head 40 relative to the housing 10. The spring harness 110 may be held vertically movable relative to the housing 10 by loose engagement of the studs 17 and the holes 112 so that the chassis 60 is held vertically movable also at this connection. The upward displacement of the chassis 60 is limited by engagement of a flange 63 on the chassis 60 with the base plate 18, as seen in FIG. 6. A seal ring 78 made of foamed urethan resin is disposed around the chassis 60 and held between the flange 63 and a flange 19 on the interior of the housing 10 for tight sealing between the chassis 60 and the upper end of the housing 10. The seal ring 78 can deform elastically to keep the tight sealing during the floating movement of the chassis relative to the housing.

Figure 13:
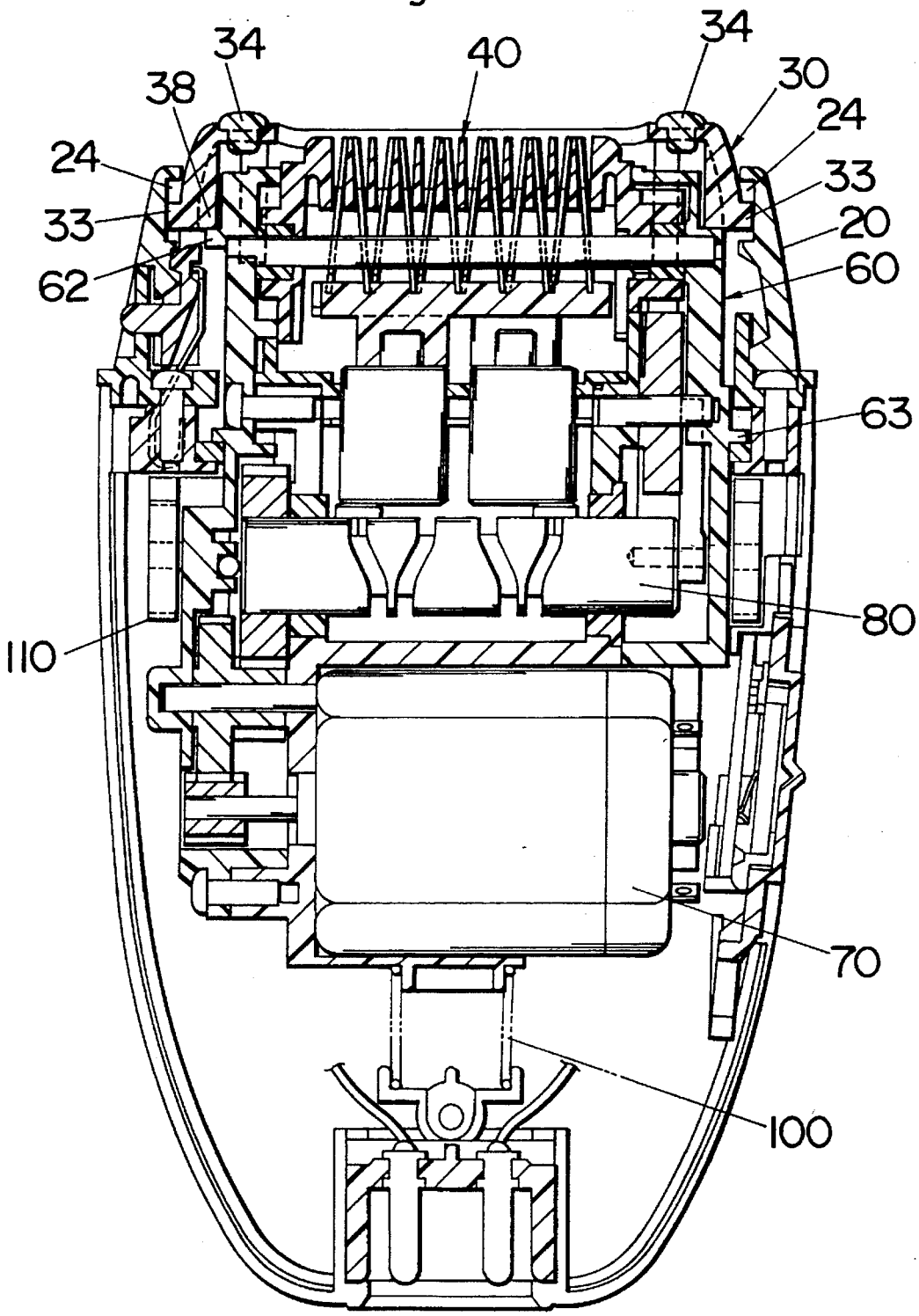
FIG. 13 is a vertical section of the device, which is similar to FIG. 1 but illustrates the plucking head in a depressed position.
Figure 14:
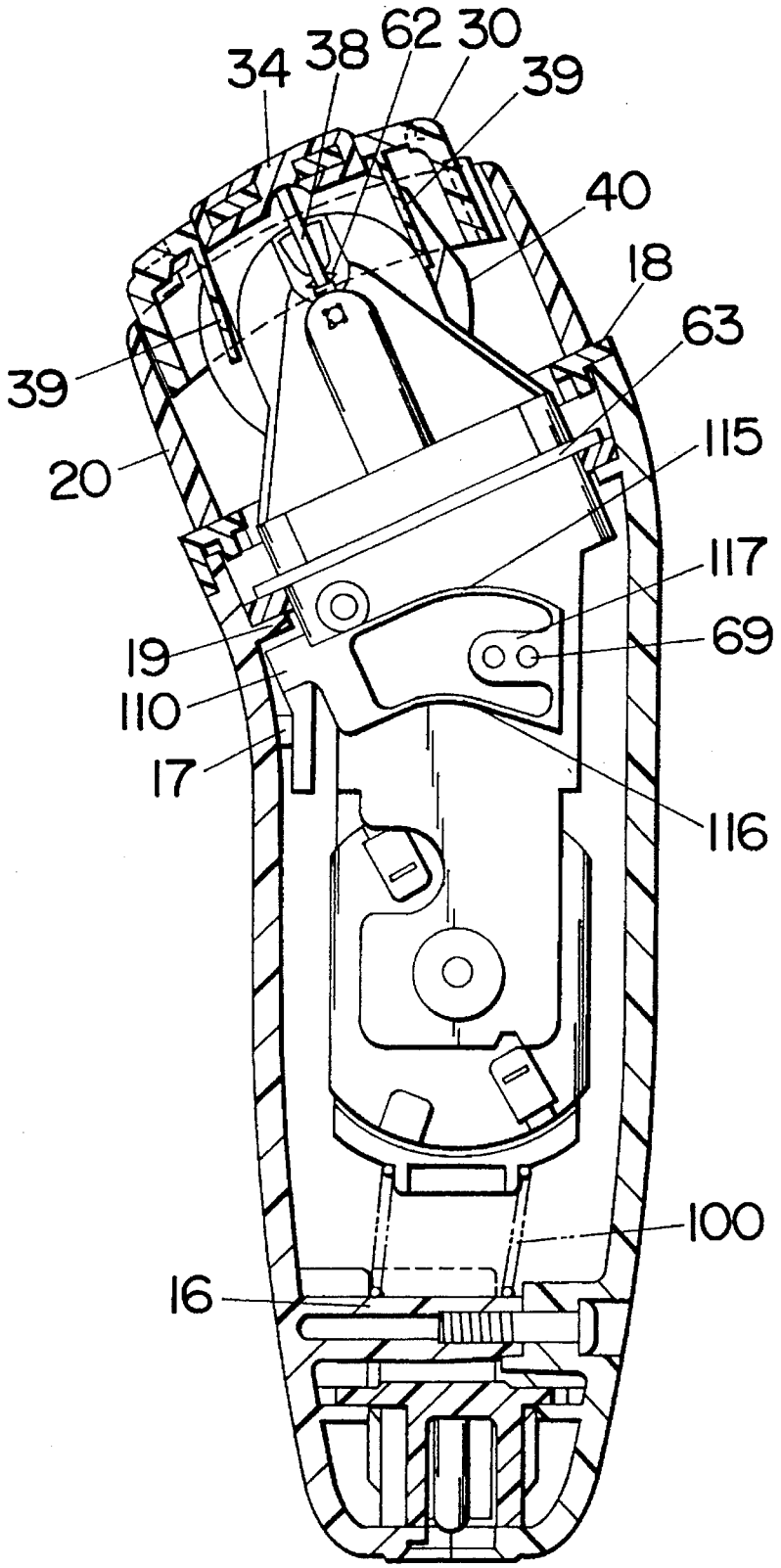
FIGS. 14 to 16 are vertical sections taken along line Z—Z of FIG. 2 with the plucking head shown in different positions or orientations, respectively.
Figure 15:
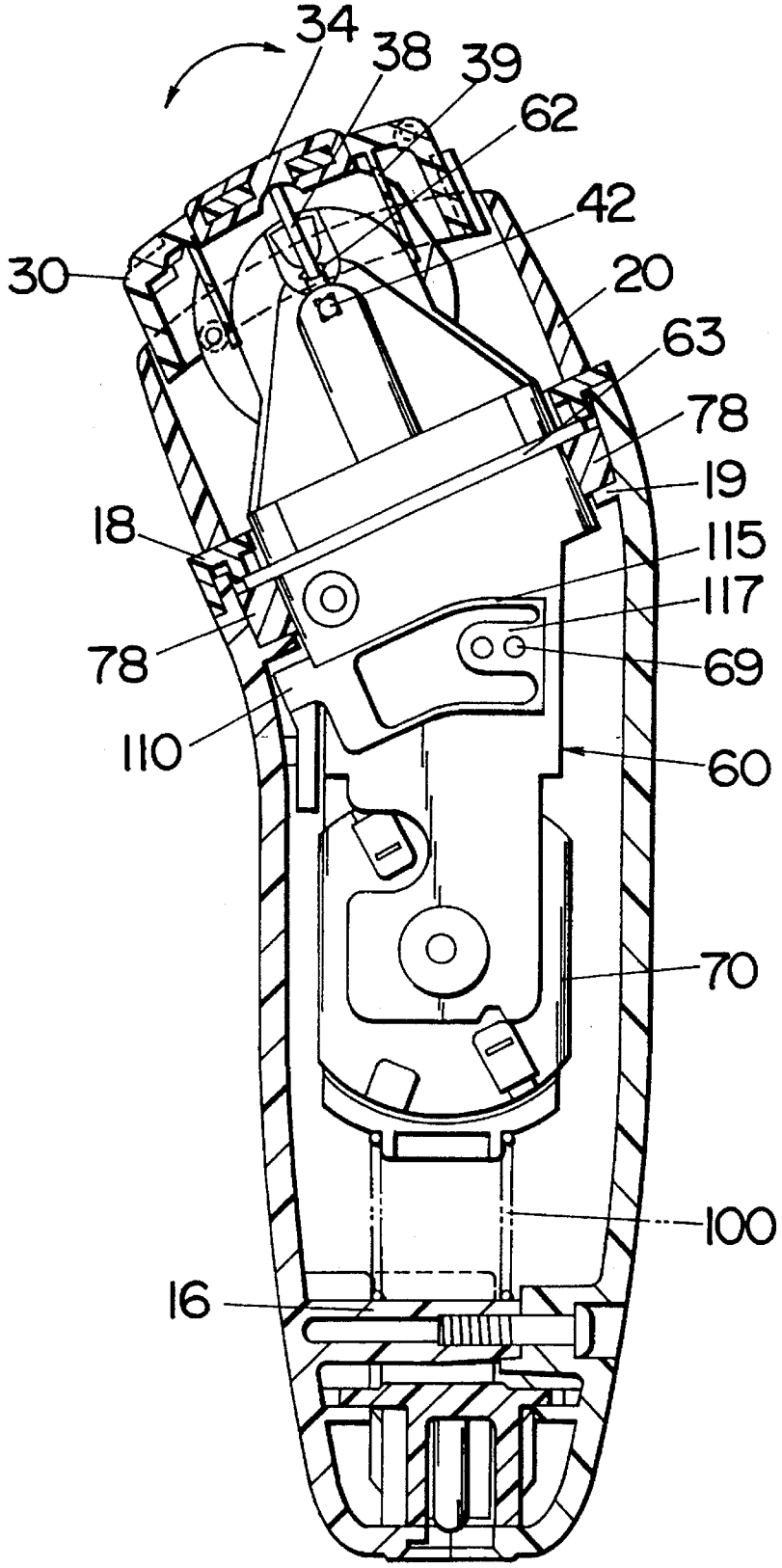
Figure 16:
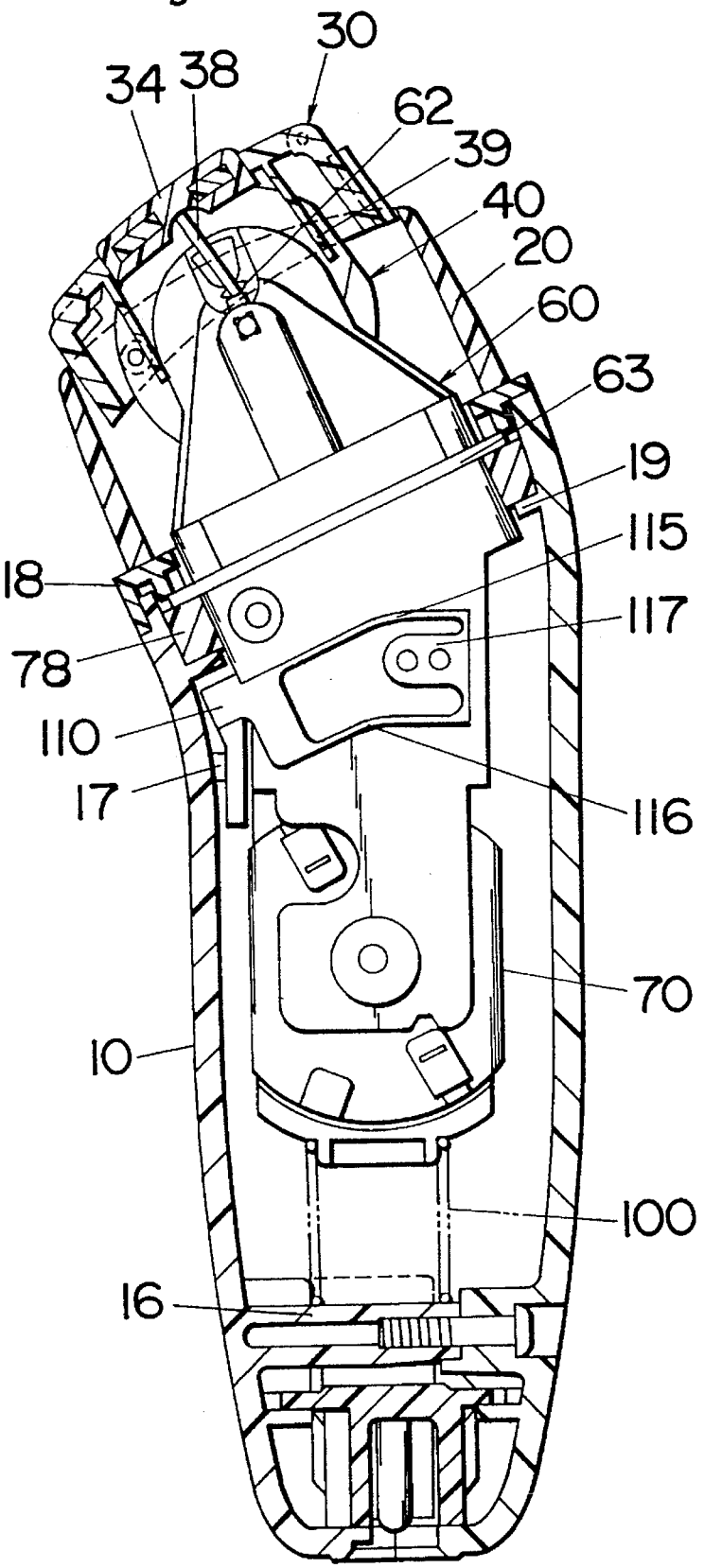

Turning back to FIGS. 1, 3, and 5, the guide frame 30 is disposed around the plucking head 40 for contact with the skin and is guided in the advancing direction as defined in the above for successively plucking the hairs. The guide frame 30 is of a generality configuration with a pair of end bars 31 extending in parallel with the end walls of the head frame 20 and a pair of opposed side bars 32. The guide frame 30 is fitted within the head frame 20 by engagement of pins 33 on the end walls 31 into corresponding vertical grooves 24 in the inner surface of the end walls 21 of the head frame 20 in such a manner that the guide frame 30 is vertically movable relative to the head frame 20 and is also pivotable about an axis of the pins 33. Formed centrally in the inner surfaces of the opposed end bars 31 are positioning limbs 38 of which lower ends rest on bearing shoulders 62 respectively formed at the opposite upper ends of the chassis 60, as shown in FIG. 2, when the head frame 20 is attached to the housing 10, such that the guide frame 30 can be depressed together with the chassis 60, or the plucking head 40. In other words, the guide frame 30 when assembled to the housing 10 can be floatingly supported together with the chassis 60 by the common spring structure composed of the coil spring 100 and the harness 110, so that the guide frame 30 and the plucking head 40 can be depressed together relative to the housing 10, as shown in FIGS. 13 and 14. Further, the guide frame 30 includes a pair of resilient flaps 39 which depend from the opposed ends of each end bar 31 and engage with the upper end of the chassis 60, as best shown in FIGS. 14 to 16, so that when the guide frame 30 pivots relative to the head frame 20 and to the plucking head 40, as shown in FIG. 16, one of the resilient flaps 39 flexes resiliently to give a return bias for returning the guide frame 30 to a neutral position of FIG. 15. In this connection, the positioning limbs 38 have their lower ends abutted against the corresponding bearing shoulders 62 at the upper end of the chassis 60 in such a manner that the guide frame 30 is permitted to pivot relative to the plucking head 40 within a limited angular range about an axis parallel to the longitudinal axis of the plucking head 40. That is, the bearing shoulder 62 has a rounded surface on which the lower end of the positioning limb 38 is received. Due to this pivoting movement, the guide frame 30 can be placed into contact with the skin at an optimum angle relative to the housing 10 for easy and comfortable handling of the device. The guide frame 30 can be detached together with the head frame 20 from the housing 10 for easy cleaning of the plucking head 40.

Figure 5:
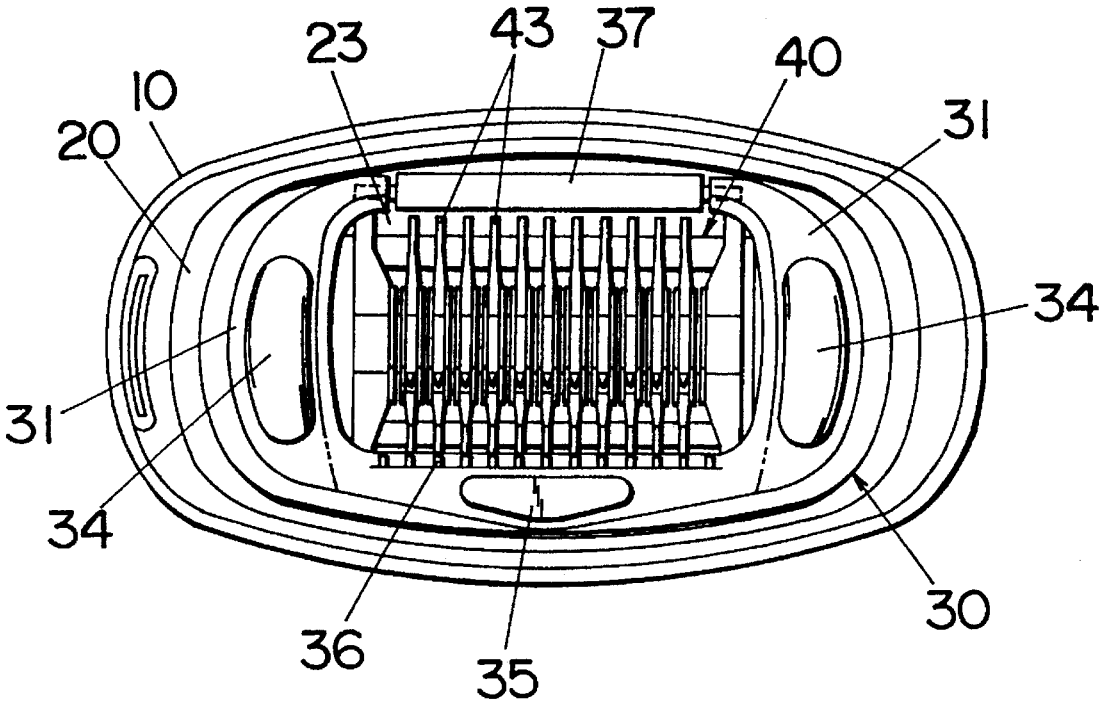
FIG. 5 is a top view of the device.

The guide frame 30 is provided on its end bars 31 respectively with wing stretcher ribs 34 for sliding engagement with the skin. In addition, one of the side bars 32 which is located forward with respect to the advancing direction A of the guide frame 30 is provided with a front stretcher rib 35 for sliding engagement with the skin, while the other side bar 32 is provided with an elongated roller 37 for rolling contact with the skin. Further, comb projections 36 are formed along the inner edge of the side bar 32 immediately behind the front stretcher rib 35 for lifting and smoothing the incoming hairs prior to plucking the hairs. The front and wing stretcher ribs 35 and 34 are made of an elastic material exhibiting a relatively strong grip to the skin so that when the guide frame 30 is manipulated to move in the advancing direction A, the stretcher ribs act to stretch the skin from which the hair is removed by the plucking head 40. As shown in FIG. 5, the wing stretcher ribs 34 are spaced longitudinally and symmetrically shaped into a somewhat arcuate configuration with the leading ends of the ribs 34 offset longitudinally inwardly. The front stretcher rib 35 is disposed longitudinally centrally of the guide frame 30 and shaped into a somewhat triangular configuration pointing forwardly of the advancing direction A of the guide frame 30. As the guide frame 30 is advanced in contact with the skin, the front and wing stretcher ribs 35 and 34 are cooperative to stretch the skin forward and sidewards so that the plucking head 40 follows to pluck the hairs from the stretched skin without irritating the skin. The front and wing stretcher ribs 35 and 34 are configured to have their top surfaces inclined downwardly and forwardly with respect to the advancing direction A, as seen in FIG. 17B, in order to effect smooth guiding of the head frame 30 and effective skin stretching by the stretcher ribs.

Figure 17A:
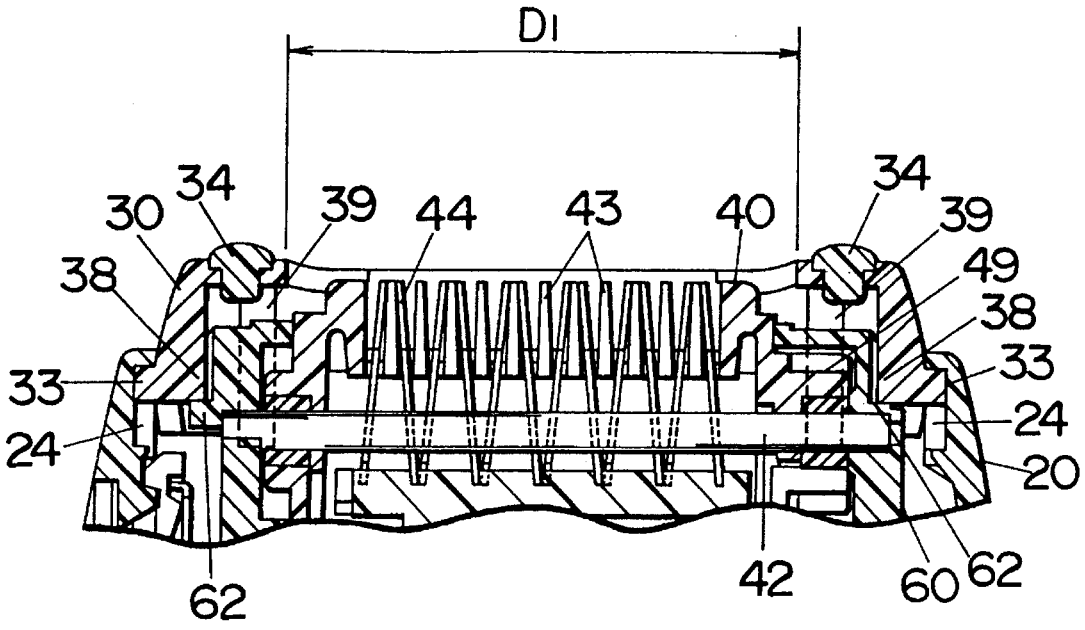
FIGS. 17A and ! 8A are vertical sections of the plucking head, respectively.
Figure 17B:
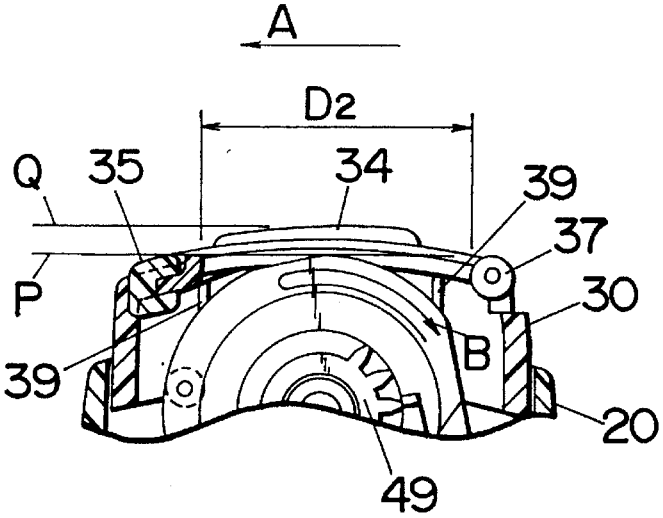
FIGS. 17B and 18B are side sections of the plucking head, respectively.
Figure 18A:
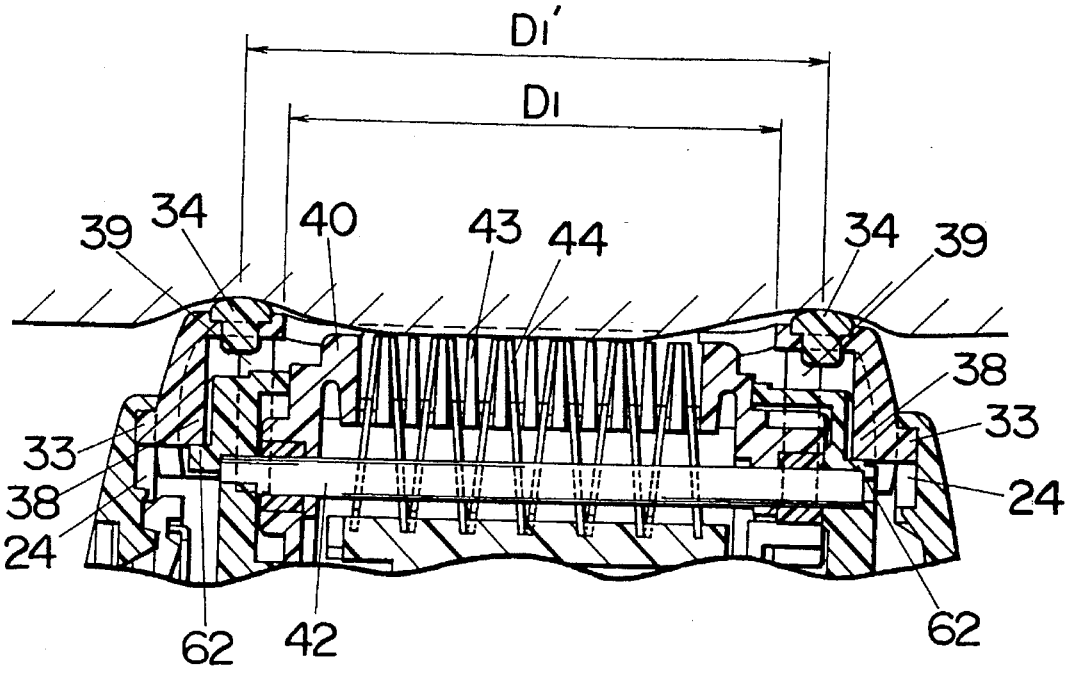
Figure 18B:
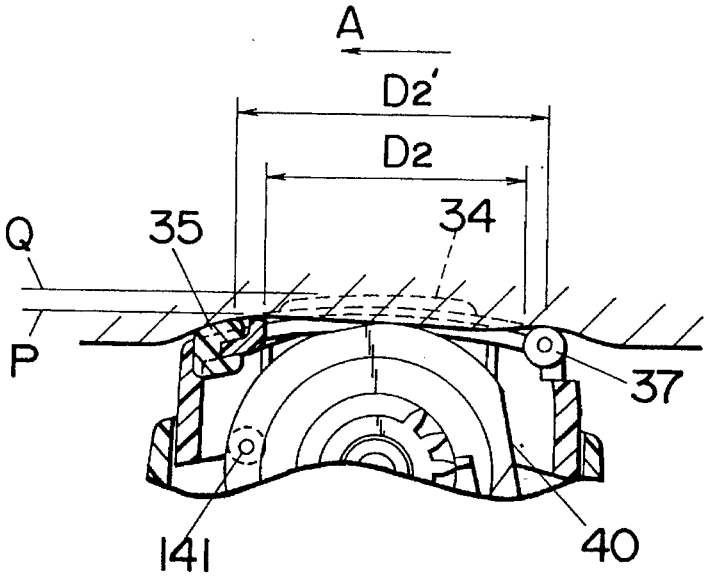
Figure 19A:
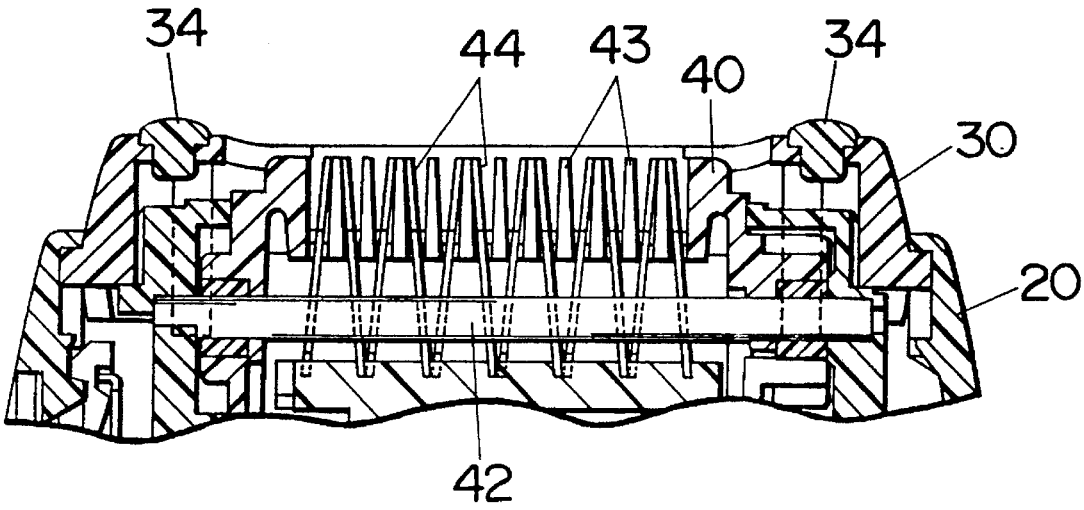
FIGS. 19A and 19B are vertical and side sections of a modified plucking head, respectively.
Figure 19B:
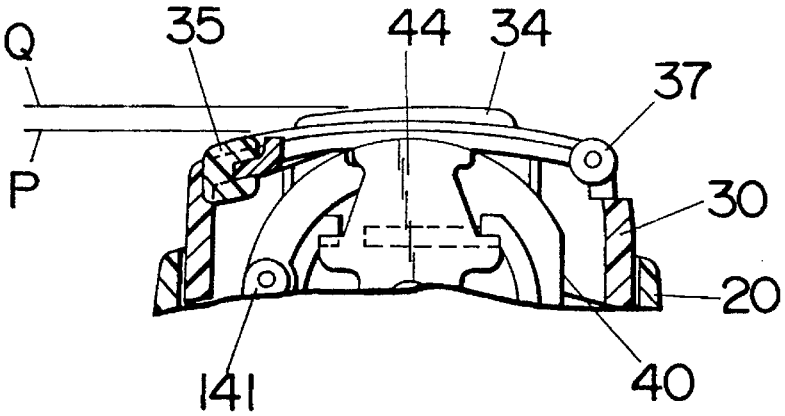

As shown in FIGS. 17A and 17B, the upper surface of the front stretcher rib 35 defines a lower contacting plane P which is substantially in level with the upper extremity of the plucking head 40 in its position of plucking the hairs and which is lower than a top contacting plane Q defined by the upper surfaces of the wing stretcher ribs 34. It is noted here that the guide frame 30 has a generally rectangular opening having a lengthwise distance D1 greater than a widthwise distance D2 and accordingly a lengthwise distance $D_1$, between the opposed wing stretcher ribs 34 is greater than a widthwise distance $D_2$, between the front stretcher rib 35 and the roller 37. In consideration of the dimensions of the guide frame 30, the wing stretcher ribs 34 are made to have a greater amount of projection than the front stretcher rib 35 in order to prevent excessive protrusion of the skin over a longer distance between the wing stretcher ribs 34 than between the front stretcher rib 35 and the roller 37, thereby avoiding the plucking head from being pressed strongly to the skin and therefore assuring the hair plucking without irritating the skin and causing unpleasant feeling. The lower contacting plane P may be alternately designed to be slightly higher than the upper extremity of the plucking head 40, as shown in FIG. 19B, in order to enable intimate contact with the skin for plucking the hairs on rather concave or convex portion. In this modification, however, the top contacting plane Q is kept higher than the contacting plane P.

Figure 8:
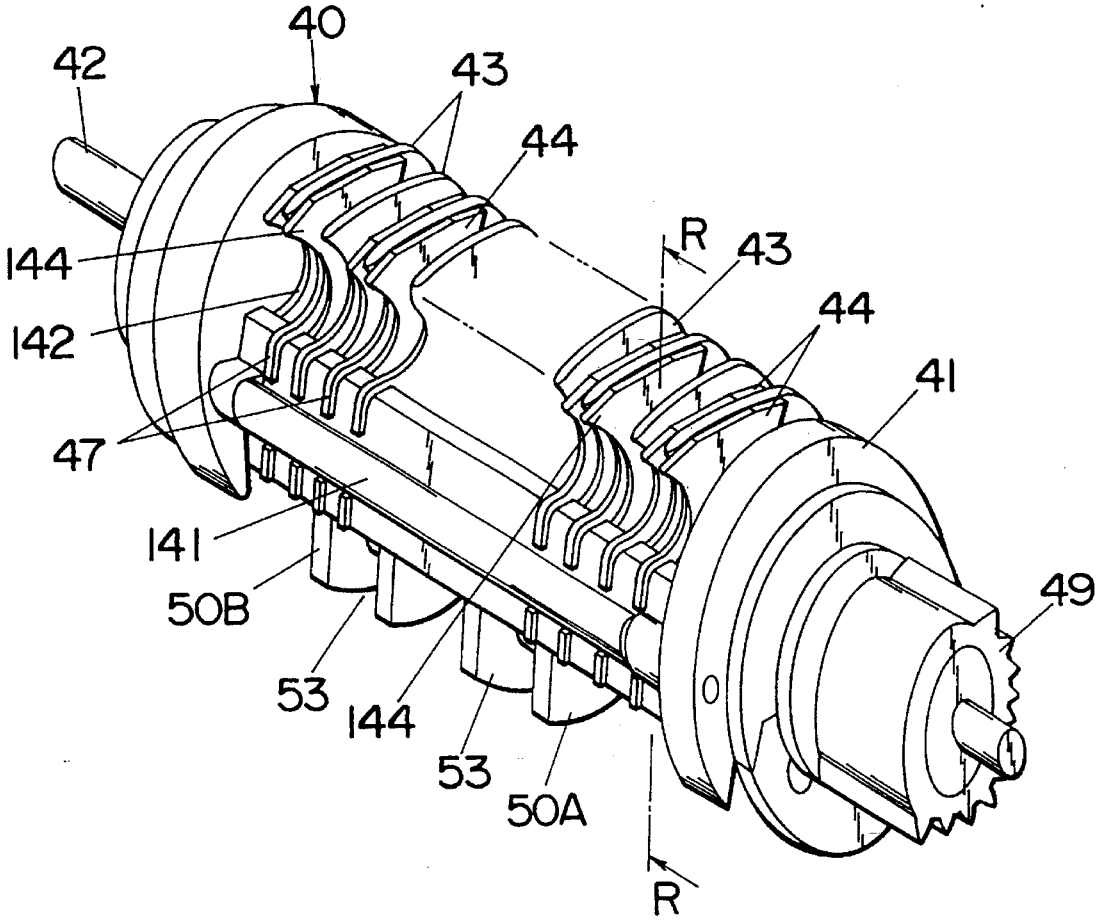
FIG. 8 is a perspective views of a plucking head of the device.
Figure 9:
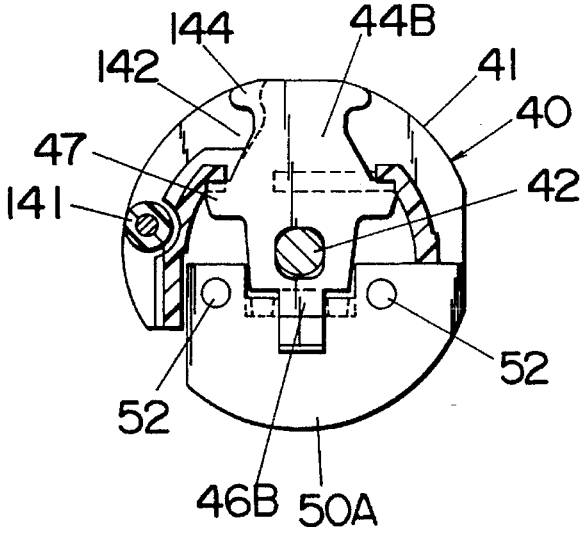
FIG. 9 is a sectional view taken along line R—R of FIG. 8.
Figure 10A:
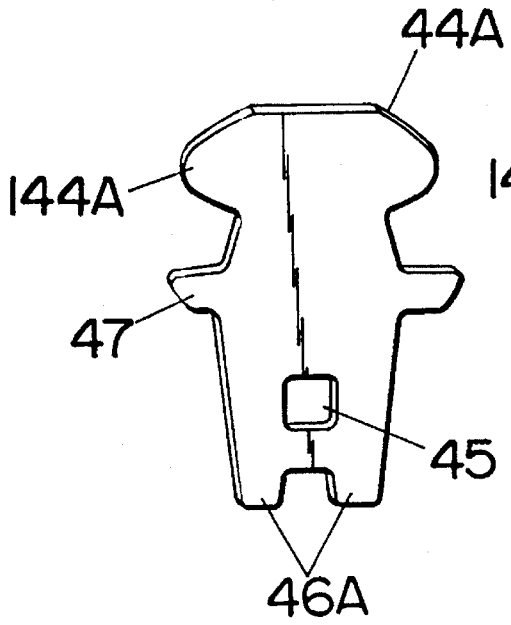
FIGS. 10A and 10B are perspective views of movable pinching plates constituting the plucking head.
Figure 10B:
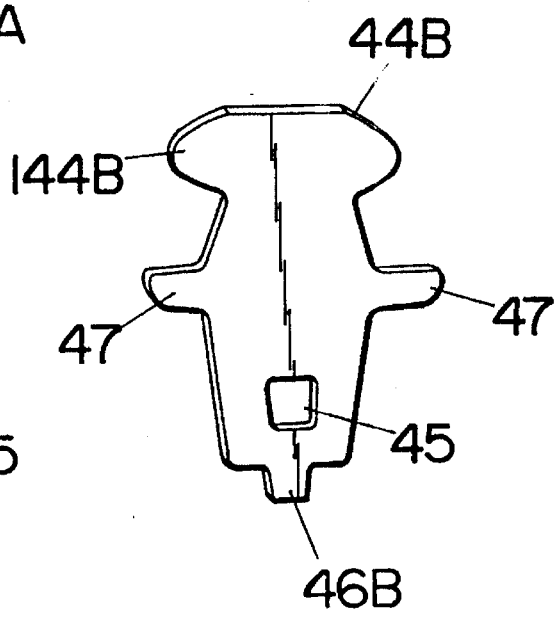

As shown in FIGS. 3 and 9, the plucking head 40 is formed to have a concavity 142 which is located forwardly of the pinching plates 43 and 44 with respect to the forward movement of bringing the pinching edges of the plates into contact with the skin from the retracted position and which is located behind the skin guide roller 141. The presence of the concavity 142 can facilitate to effectively gather the hairs and guide them into between the pinching plates 43 and 44, while the skin guide roller 141 precedes the concavity 142 to protect the skin from being injured by the end of the concavity. As shown in FIGS. 8 and 9, the movable pinching plate 44 has its leading end portion 144 projected relative to the adjacent leading end portion of the fixed pinching plate 43 in the direction of the forward movement of the plucking head 40 about the shaft 42, so that the end portion 144 project over the upper end of the concavity 142 and act to smoothly introduce the hairs between the adjacent pinching plates 43 and 44 for effective hair plucking. As shown in FIGS. 10A and 10B, the movable pinching plates 44A and 44B may be designed to have the leading end portions 144A and 144B with different projecting amounts for giving still improved hair catching capability. In this modification, the movable pinching plate 44B has the end portion 144B shaped into a somewhat acute configuration so as to enable the end portion 144B to lift the hairs prior to introducing the hairs into between the adjacent pinching plates for effective hair plucking. cl Second Embodiment <FIGS. 20 to 31>

Figure 20:
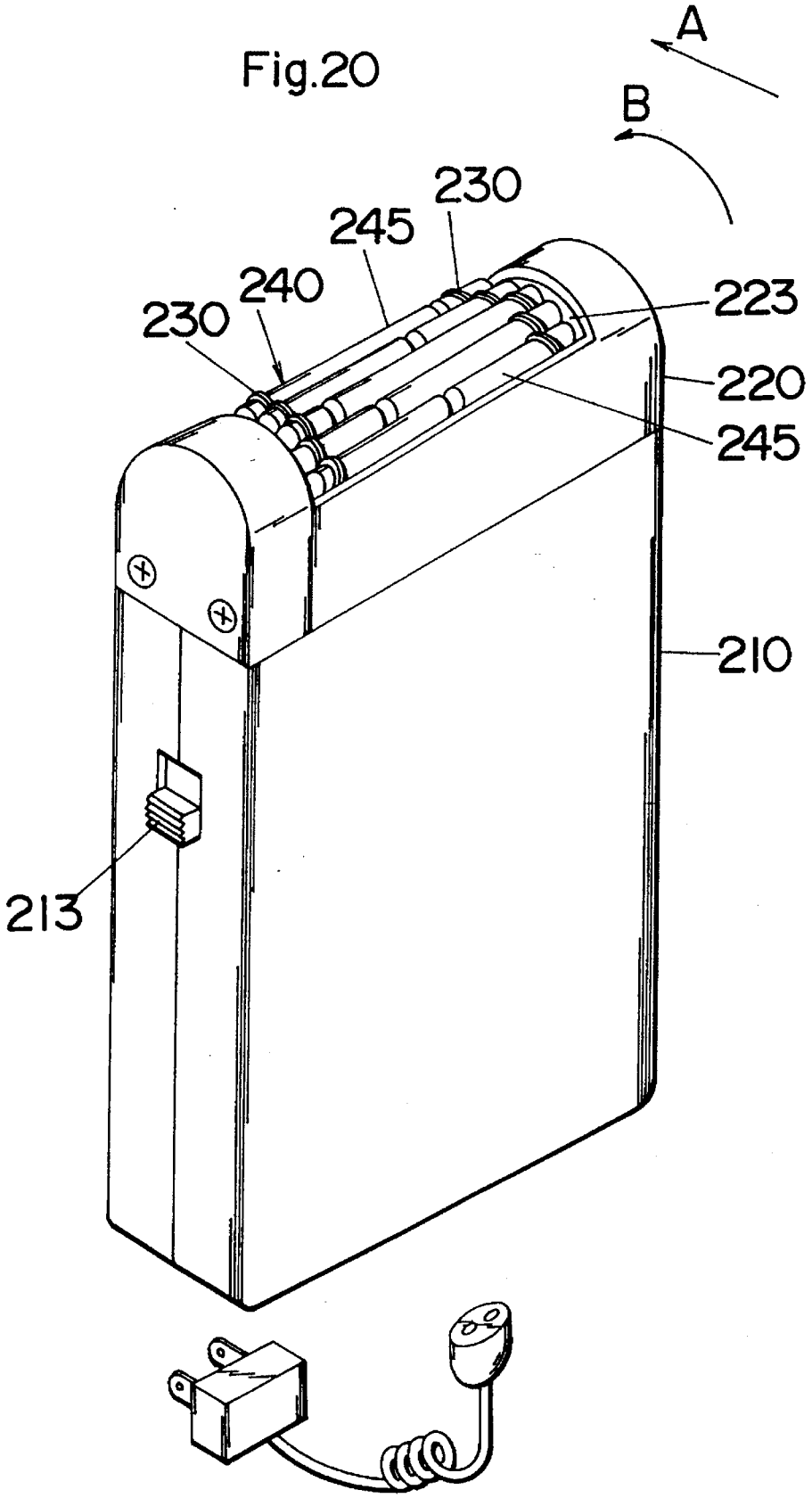
FIG. 20 is a perspective view of a depilating device in accordance with a second embodiment of the present invention.
Figure 21:
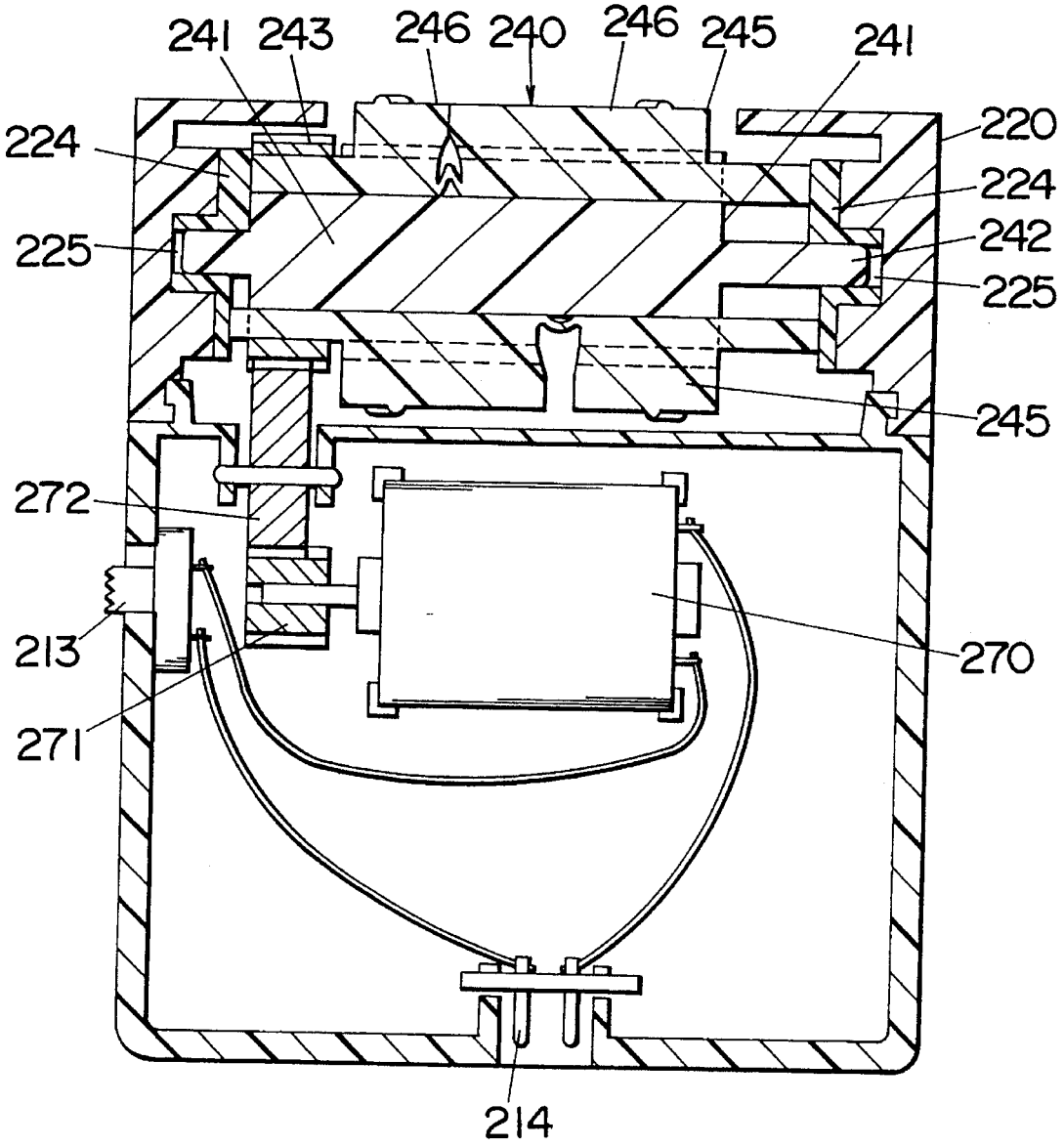
FIG. 21 is a vertical section of the device of FIG. 20.
Figure 22:
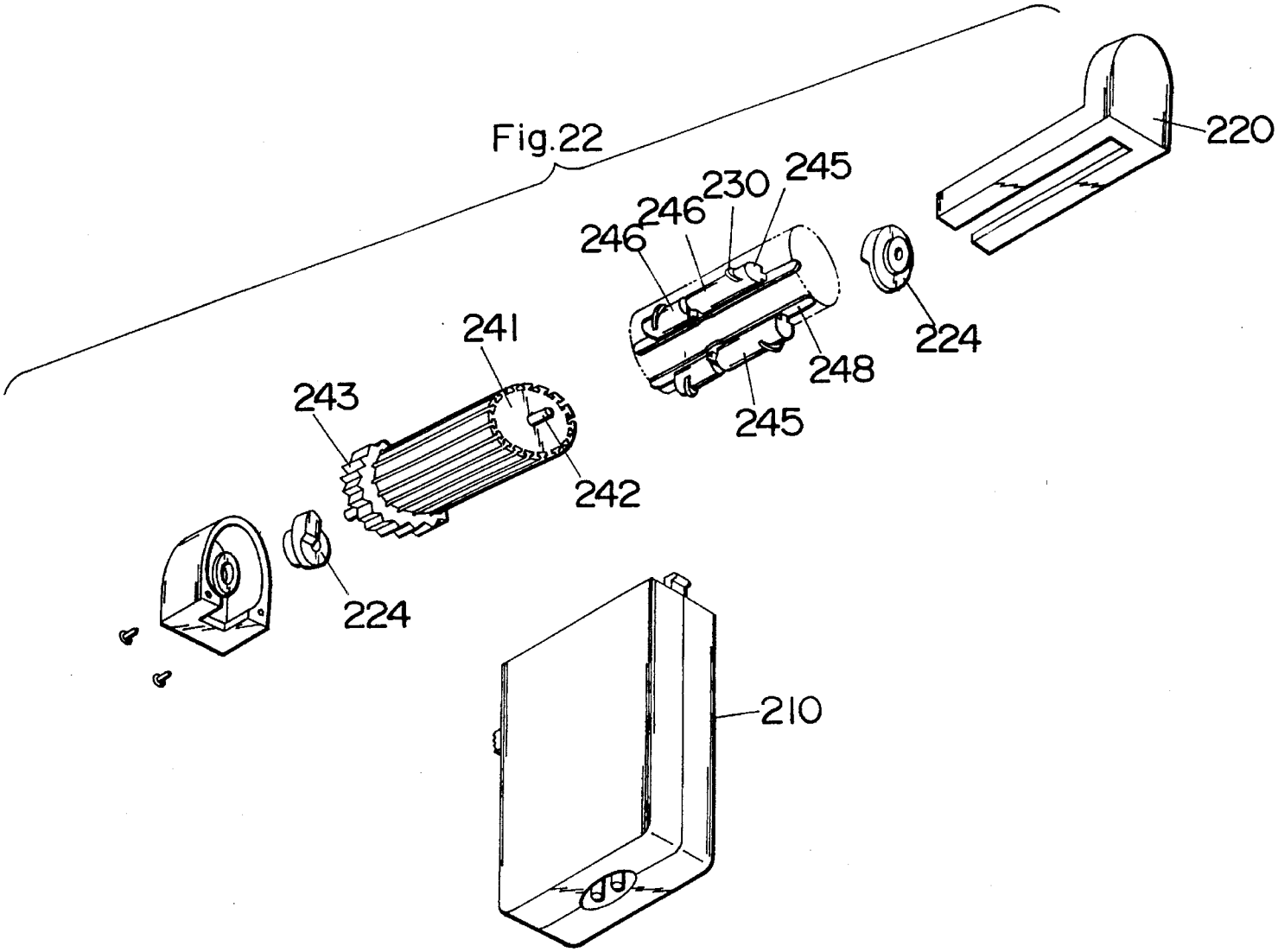
FIG. 22 is an exploded perspective view of the device of FIG. 20.
Figures 23, 24:
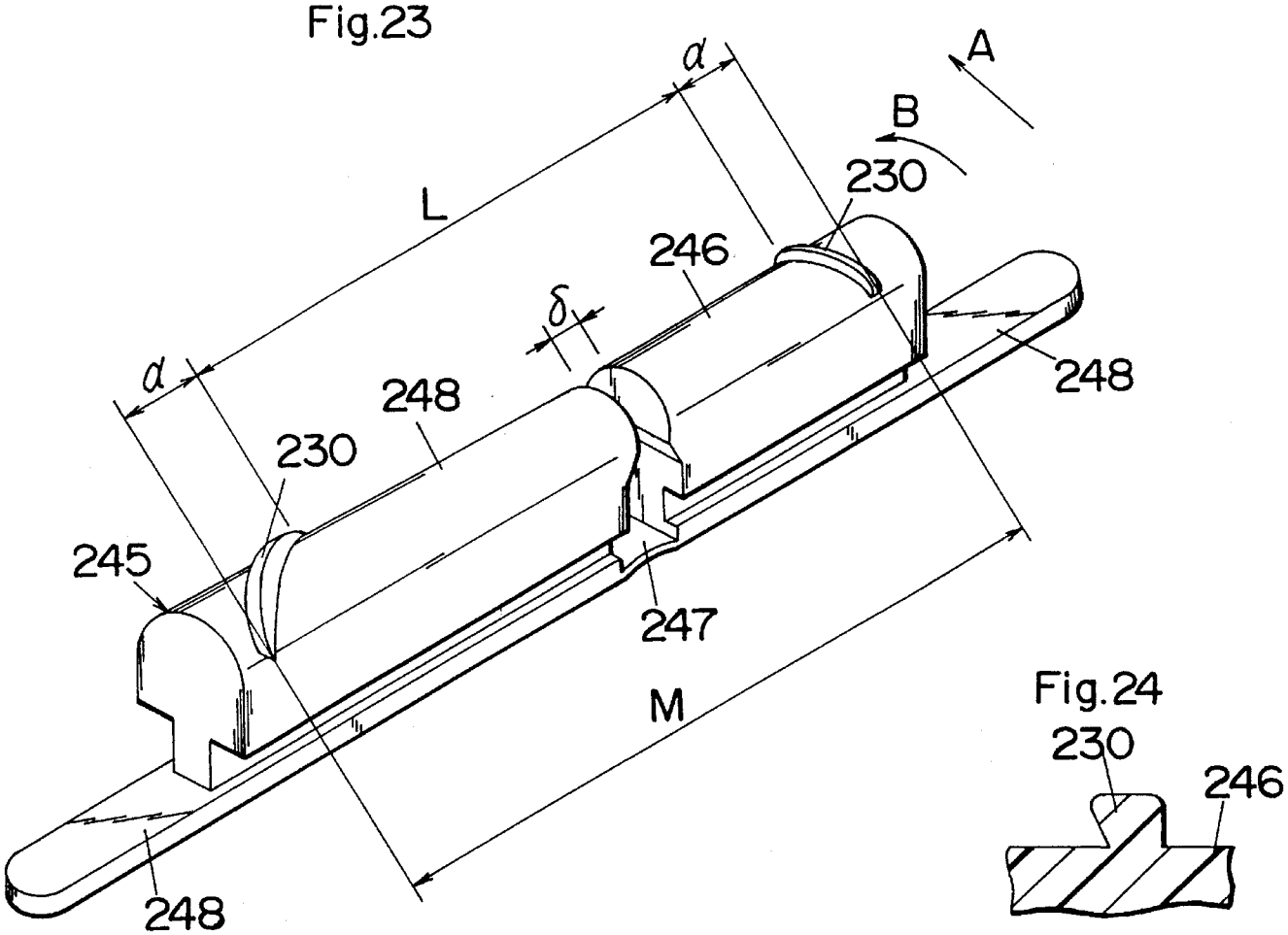
FIG. 23 is a perspective view of pinching elements utilized in the device of FIG. 20.
FIG. 24 is a sectional view of a portion of the pinching element.
Figures 25A, 25B, 25C, 26A, 26B, 26C:
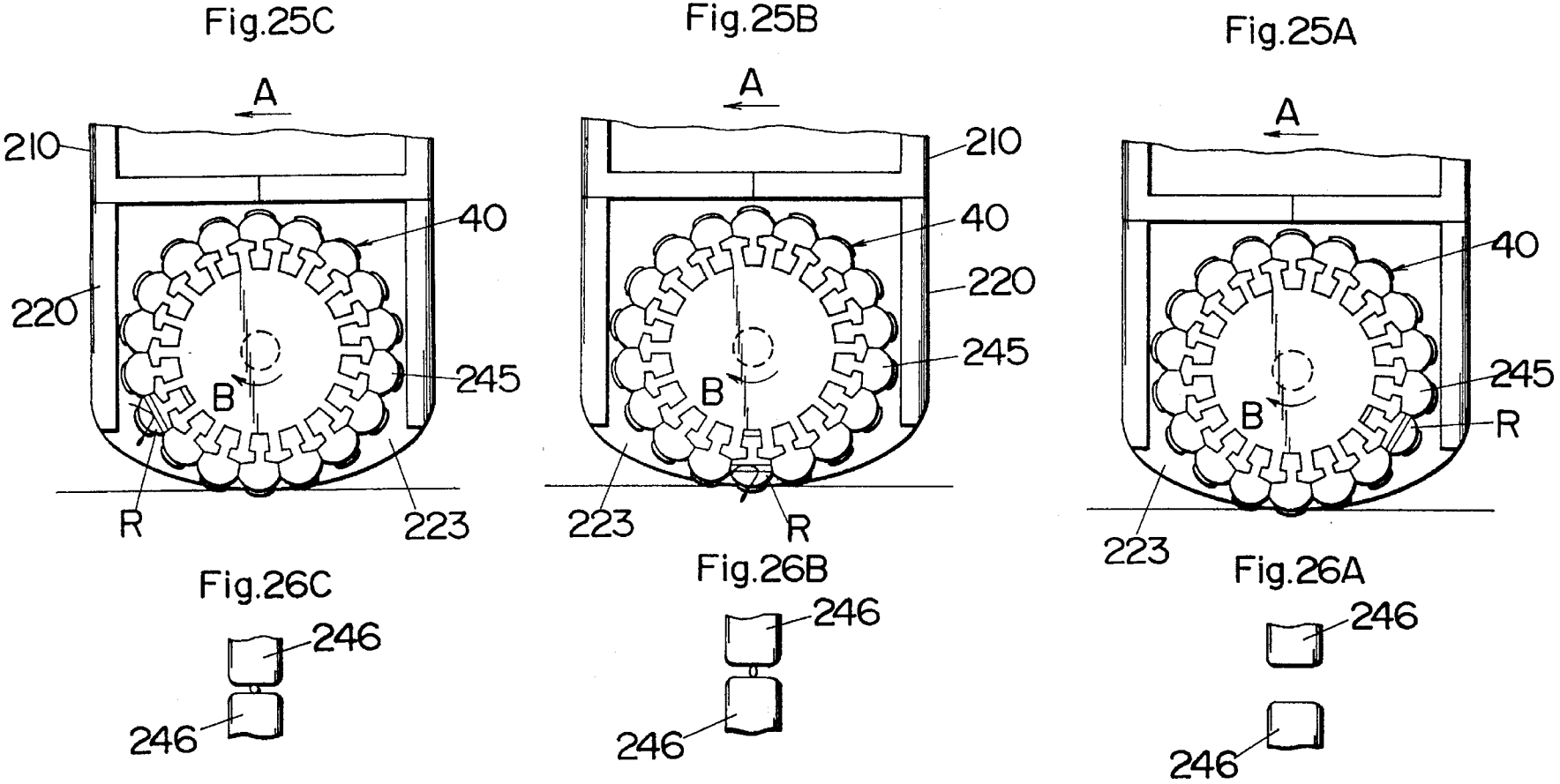
FIGS. 25A to 25C and FIGS. 26A to 26C are views illustrating the plucking operation in sequence of the device.
Figure 27:
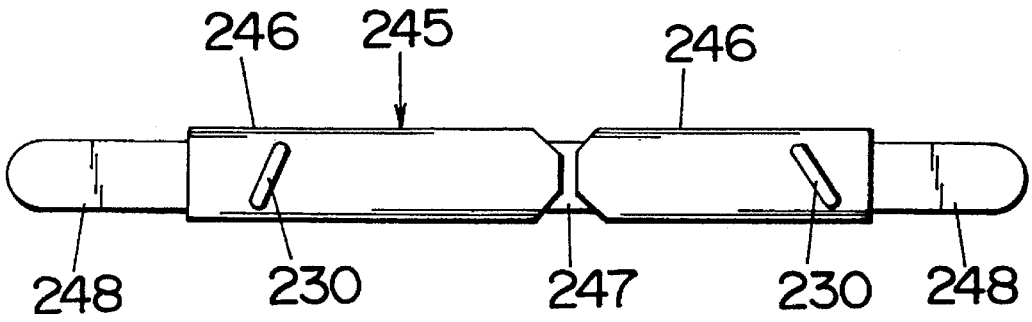
FIG. 27 is a top view of the pinching elements with stretcher ribs.

Referring to FIGS. 20 to 22, there is shown a second embodiment of the present invention which comprises a housing 210 and a head frame 220 detachably mounted on top of the housing 210. The head frame 220 has a generally rectangular opening 223 into which a portion of a plucking head 240 is exposed. The plucking head 240 comprises a rotary barrel 241 which defines a longitudinal axis of the head and carries a plurality of circumferentially spaced rods 245. As shown in FIGS. 21 and 22, the barrel 241 has a center shaft 242 projecting from the longitudinal ends thereof and journaled respectively in bearing holes 225 of cam plate 224 secured interiorly of the head frame 220. The barrel 241 is formed at its one end with a gear 243 which is connected via a reduction gear 272 to a pinion 271 of a motor 270 accommodated in the housing 210 so that the barrel 241 is driven to rotate in one direction B about its longitudinal axis. The motor 270 is electrically connected through a power switch 213 to terminal pins 214 receiving electric power from an external power source. The rod 245 is made of an elastic material to comprises a pair of axially elongated pinching pieces 246 each having a rounded top contour and an integrally molded foot bar 248. The pinching pieces 246 are integrally connected at the foot bars 248 by means of a tongue joint 247 which is thin enough to allow the pinching pieces 246 to move toward and away from each other for closing and opening a gap formed therebetween, and which is given a resiliency for returning the pinching pieces 246 in the direction of opening the gap. Thus configured rods 245 are mounted on the barrel 241 by inserting the foot bars 248 into corresponding grooves 244 so as to be slidable along the longitudinal axis. The opposite longitudinal ends of each rod 245, i.e, the outward ends of the foot bars 248 are held abutted respectively against cam surfaces of the cam plates 224. The cam surface is configured to displace the pinching pieces 246 axially for closing and opening the gap as the barrel 241 rotates. In particular, as shown in FIGS. 25A to 25C and 26A to 26C, as the barrel 241 rotates in the direction of B, the rod 245 (indicated by R in the figures) has its gap kept opened until it comes to a center of the opening 223 or a plucking position for contact with the skin. When the rod R comes to this position of FIG. 25B, the pinching pieces 246 are caused to displace axially inwardly to close the gap by resiliently flexing the joint 247 for pinching the hairs therebetween, as shown in FIG. 26B. The rod R further rotates over a limited angular range to a position of FIG. 25C while kept closing the gap for plucking the hairs, after which the pinching pieces 246 are caused to displace axially outwardly by the resiliency of the joint 247, thereby opening the gap ready for subsequent hair plucking. In this manner, the hair plucking is continuously made by a plurality of the rods 245. The rods 245 are arranged circumferentially on the barrel 241 in such a manner that the gaps of the individual rods are staggered with respect to the lengthwise axis of the barrel 241. It is noted that the plucking head 240, i.e., the housing 210 is given an advancing direction A of moving along the skin in connection with the rotating direction B of the plucking head 240 such that the rod 245 follows to rotate forwardly of the advancing direction A when it comes into the plucking position from within the head frame 220. As best shown in FIGS. 23 and 27, each rod 245 includes a pair of skin stretcher ribs 230 each integrally formed on each the pinching pieces 246. The stretcher ribs 230 are symmetrical with respect to the advancing direction A and inclined thereto in such a manner as to have a minimum lenthwise spacing L between the leading ends of the ribs 230 and a maximum lengthwise spacing M between the trailing ends of the ribs 230. When the rod 245 rotates in its forward stroke of plucking the hair, the stretcher ribs 230 grip the skin first at the leading ends thereof and then successively at the remaining portions, such that as the rod 245 proceeds in contact with skin, the inclined ribs act to stretch the skin forward and sidewards with respect to the advancing direction A for facilitating the hair plucking without irritating the skin. It is noted here that although the ribs 230 on the rod 245 just pinching the hair are displaced inwardly or in a direction of narrowing the spacing therebetween the ribs 230 and therefore slackening the skin in immediate contact with this rod 245, the preceding rod 245 is still kept in contact with the skin without causing axial displacement of the pinching pieces 246, whereby the ribs 230 on the preceding rod 245 keep stretched the immediately adjacent skin, enabling the following rod 245 to pluck the hair from the stretched skin. At this condition, the rearwardly adjacent rod 245 which comes after in the rotating direction of the plucking head 240 keeps its pinching pieces 246 spaced apart so that the stretcher ribs 230 thereon will not act to slacken the skin. In order to ensure effective hair plucking by the rod 245 while lessening the effect of the associated axially inward movement of the stretcher ribs 230, the maximum gap distance $\delta$ is selected to be less than a difference $2\alpha$ between the maximum lengthwise spacing M and the minimum lengthwise spacing L for the stretcher ribs 230, as shown in FIG. 23. The stretcher rib 230 is preferably to have an acute edge at least along its side outer perimeter, as shown in FIG. 24, to give a firm grip to the skin.

Figure 28:
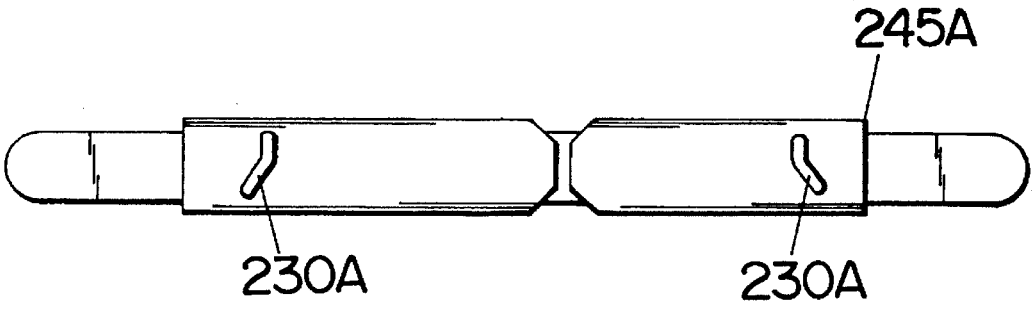
FIGS. 28 and 29 are top views of modified pinching elements with differently oriented stretcher ribs, respectively.
Figure 29:
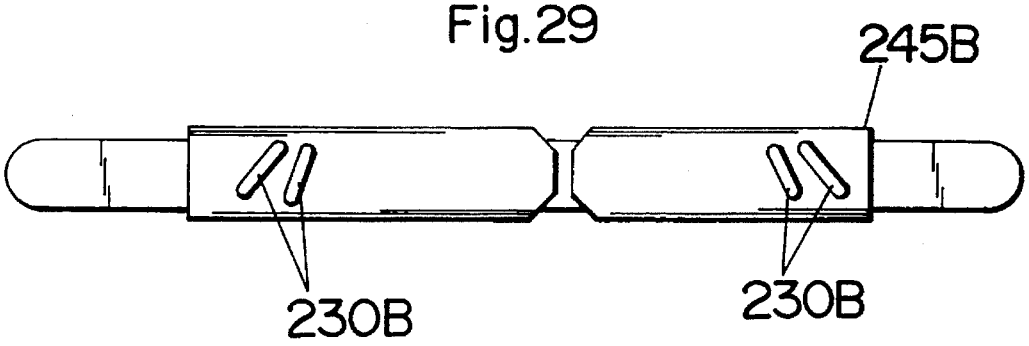
Figures 30, 31:
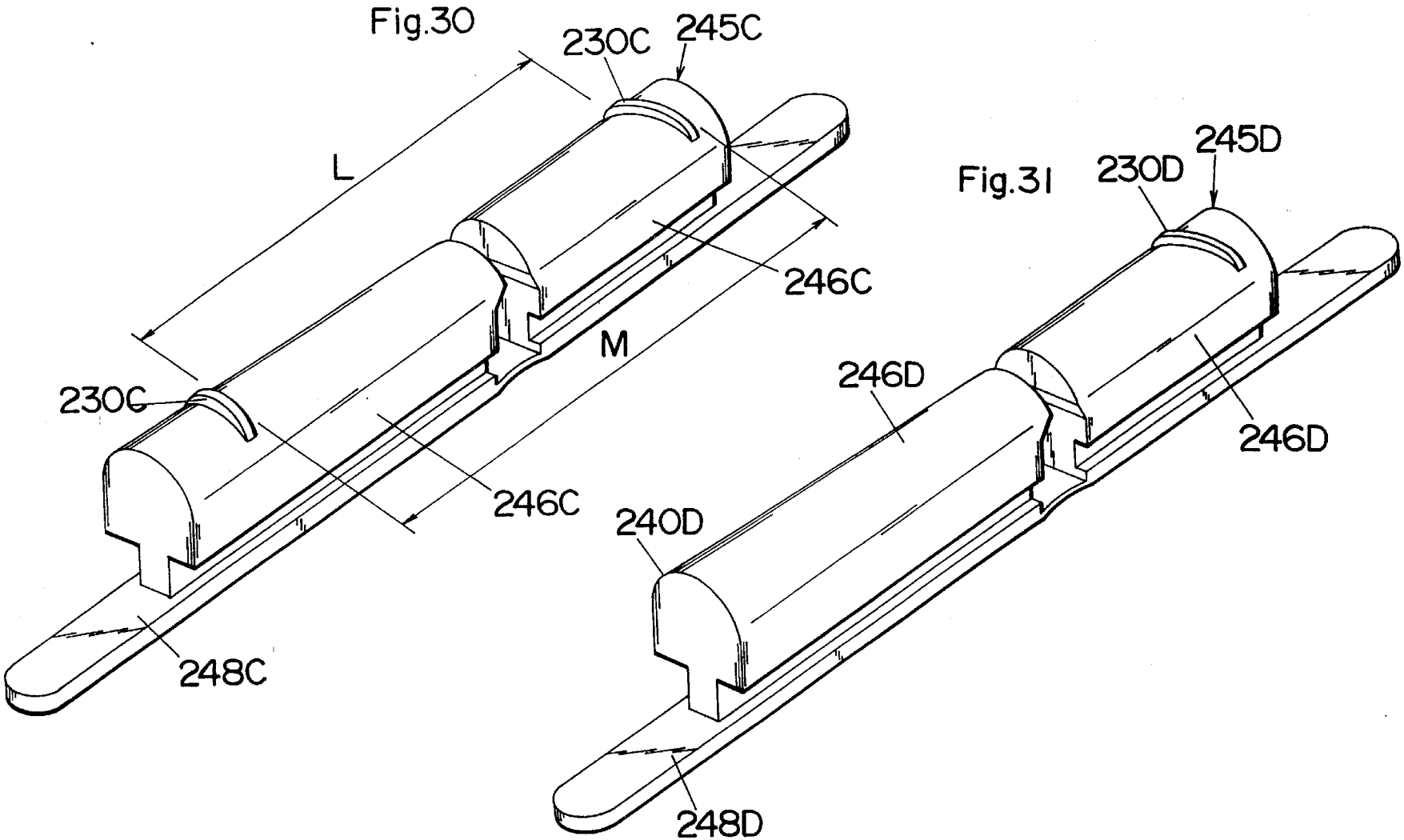
FIGS. 30 and 31 are perspective view of further modified pinching elements.

There may be several modifications for the configuration and arrangement of the stretcher ribs. As seen in FIG. 28, the stretcher rib 230A may have a straight portion extending perpendicular to the longitudinal axis of the rod 245A. In the modification of FIG. 29, the rod 240B has two pairs of the stretcher ribs 230B with the outer pair of the stretcher ribs 230B inclined with respect to the longitudinal axis by a greater extent than the inner pair of the ribs 230B. FIG. 30 illustrates the rod 245C with a pair of the stretcher ribs 230C one of which is inclined with respect to the longitudinal axis, while the other rib extends straight with respect thereto. In this modification, the maximum gap distance $\delta$ is selected to be less than the difference of the maximum lengthwise spacing M minus the minimum lengthwise spacing L between the opposed ribs 230C. As seen in FIG. 31, the rod 245D may have a single stretcher rib 230D on one of the pinching pieces 246D.

Figure 32:
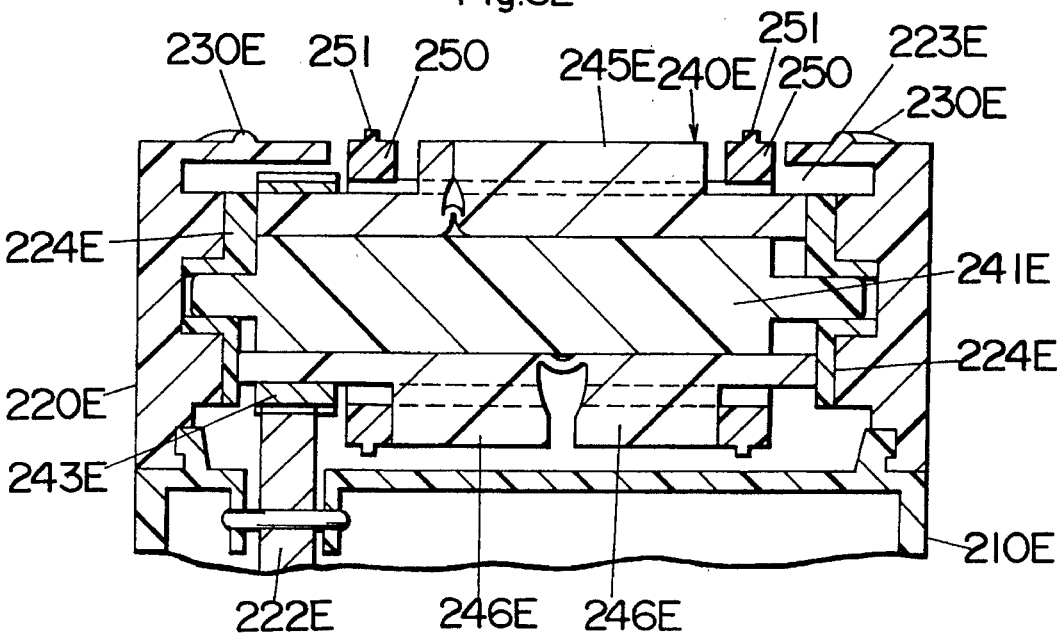
FIGS. 32 and 33 are vertical section and a top view of a plucking head of a depilating device in accordance with a third embodiment of the present invention.
Figure 33:
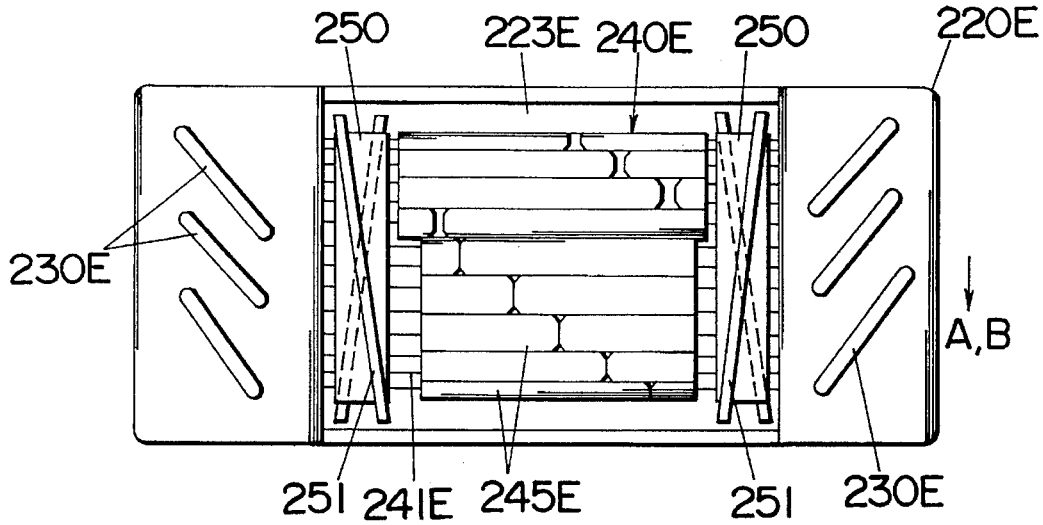

Third Embodiment <FIGS. 32 and 33>

FIGS. 32 and 33 illustrate a depilating device in accordance with a third embodiment of the present invention which is basically identical in construction and operation to the second embodiment except that stretcher ribs are formed on separate members other than rods 245E of a plucking head 240E. Like parts are designated by like numerals with a suffix letter of "E" for an easy reference purpose. In this embodiment, a head frame 220E is formed on its top around a top opening 223E with pairs of stretcher ribs 230E which are located longitudinal outwardly of the rods 245E and are inclined with respect to the advancing direction A of the housing 210E or the head frame 220E. In addition, the plucking head 240E includes a pair of rings 250 fitted on the opposed longitudinal ends of the barrel 241E to be rotatably therewith. The ring 250 is formed with a spiral stretcher rib 251 which is inclined with respect to the longitudinal axis of the plucking head 240E and therefore the advancing direction A thereof such that, as the plucking head 240E rotates in one direction B in contact with the skin, the stretcher ribs 251 act to stretch the skin sidewards, or axially outwardly of the rod 245E.

Figure 34:
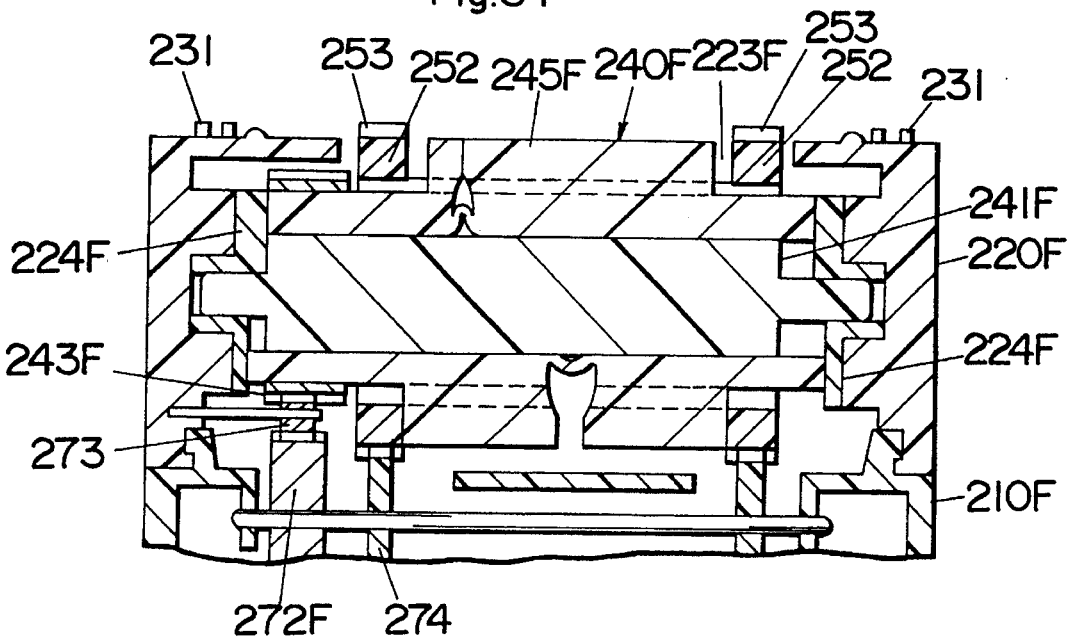
FIGS. 34 and 35 are vertical section and a top view of a plucking head of a depilating device in accordance with a fourth embodiment of the present invention.
Figure 35:
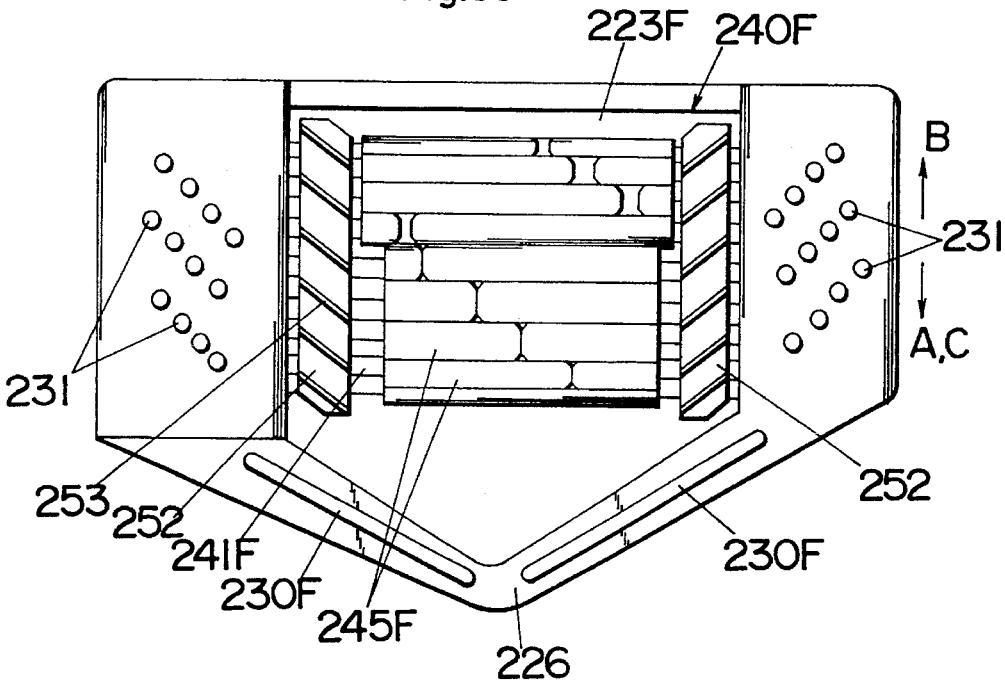

Fourth Embodiment <FIGS. 34 and 35>

FIGS. 34 and 35 illustrate a depilating device in accordance with a fourth embodiment of the present invention which is basically identical in construction and operation to the second embodiment except that stretcher ribs are formed on separate members other than rods 245F of a plucking head 240F. Like parts are designated by like numerals with a suffix letter of "F" for an easy reference purpose. In this embodiment, a head frame 220F is formed on its top around a top opening 223F with a pair of stretcher ribs 230F as well as plural arrays of stretcher projections 231. The stretcher ribs 230F are formed on an forward extension 226 of the head frame 226 which is located forwardly of the plucking head 240F with respect to the advancing direction A, while the arrays of the stretcher projection 231 are disposed longitudinal outwardly of the rods 245F and are inclined with respect to the advancing direction A of the housing 210F or the head frame 220F. In this embodiment, the barrel 214F carrying a plurality of circumferentially spaced rods 245F is driven to rotate in direction B which is in such a generally opposed relation to the advancing direction A of the housing 210F that the rods 245F comes into contact with the skin from forwardly of the advancing direction A. To this end, a reverse gear 273 is interposed between the gear 243F on the barrel 241F and the reduction gear 272F. In addition, the plucking head 240F includes a pair of helical gears 252 loosely fitted on the opposed longitudinal ends of the barrel 241F to be rotatable relative thereto. The helical gear 252 has its bevelled teeth 253 in meshing engagement with a gear 274 rotatable with the reduction gear 272F so as to driven thereby to rotate in a direction C opposite to the rotating direction B of the barrel 241F. The beveled teeth 253 are shaped to have a rounded top at which the teeth 253 come into engagement with the skin and therefore act as the stretcher ribs for stretching the skin sidewards as the helical gear 252 rotates in the direction C. As the barrel 241F is driven to rotate in the direction B which is opposite to the rotating direction C of the gears 252 and is generally opposite to the advancing direction A of the housing 210F, increased skin gripping force can be exerted by the stretcher teeth 253 as well as by the other stretcher ribs 230F and projections 231 for sufficiently stretching the skin to facilitate the hair plucking.

Figure 36:
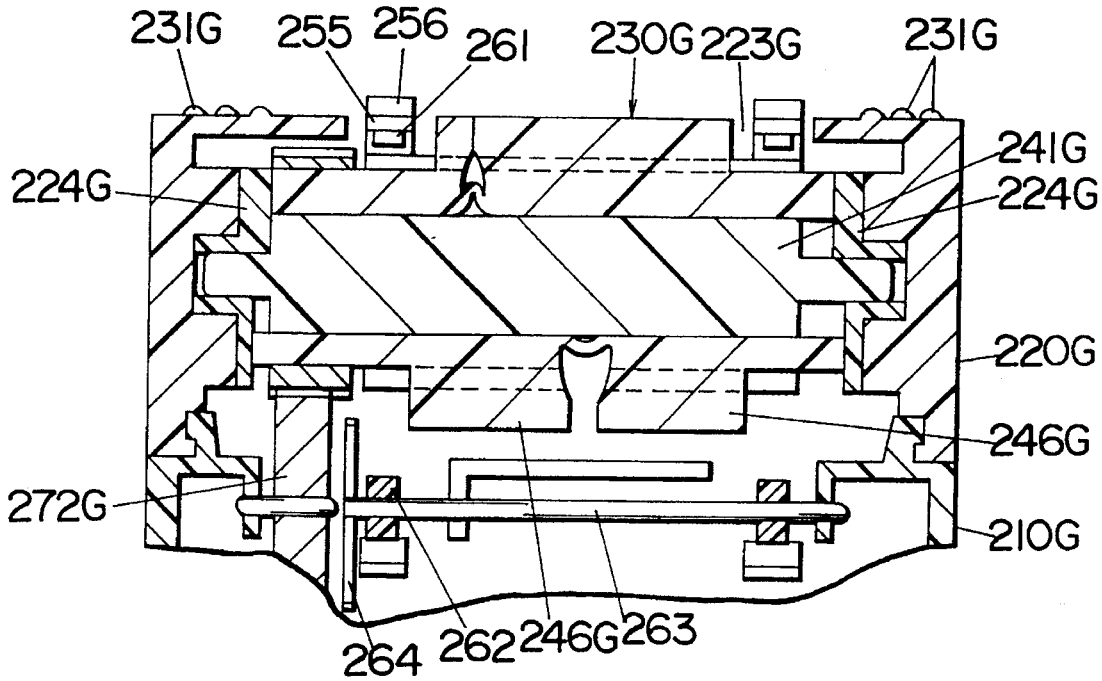
FIGS. 36 and 37 are vertical section and a top view of a plucking head of a depilating device in accordance with a modification of the fourth embodiment.
Figure 37:
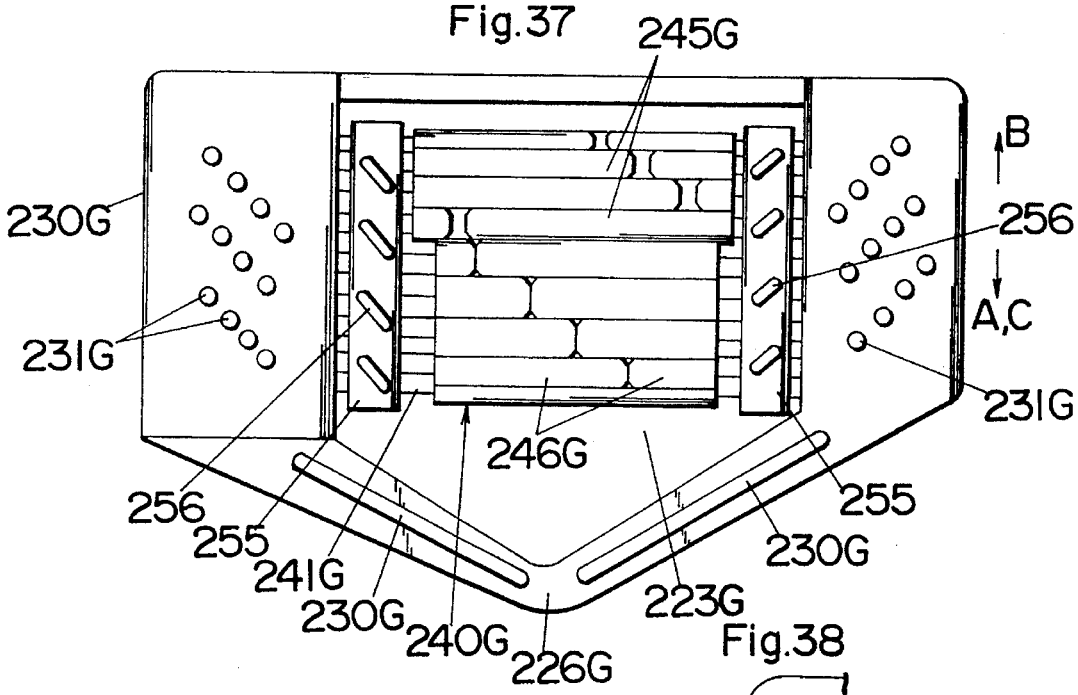
Figure 38:
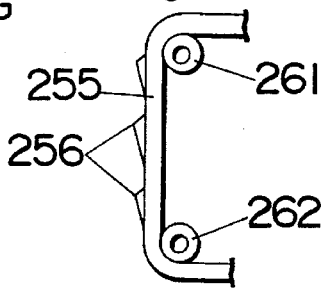
FIG. 38 is a partial view of a portion of FIG. 36.

FIGS. 36 and 37 illustrates a modification of the fourth embodiment which is identical to the fourth embodiment except that a pair of endless belts 255 are incorporated instead of the helical gears 252. Like parts are designated by like numerals with a suffix letter of "G" for an easy reference purpose. The endless belt 255 bridges over a pulley 261 disposed adjacent the opposed end of the barrel 241G and a pulley 262 on a shaft 263 which is drivingly connected to a motor (not seen) by way of a gear 264. Thus, as the shaft 263 rotates, the endless belt 255 rotates in one direction C which is opposite to the rotating direction B of the barrel 241G about the longitudinal axis. The endless belt 255 is formed with a series of stretcher ribs 256 which are inclined with respect to the advancing direction A of the housing 210 for stretching the skin in the manner as described hereinbefore with regard to the fourth embodiment.

Figure 39:
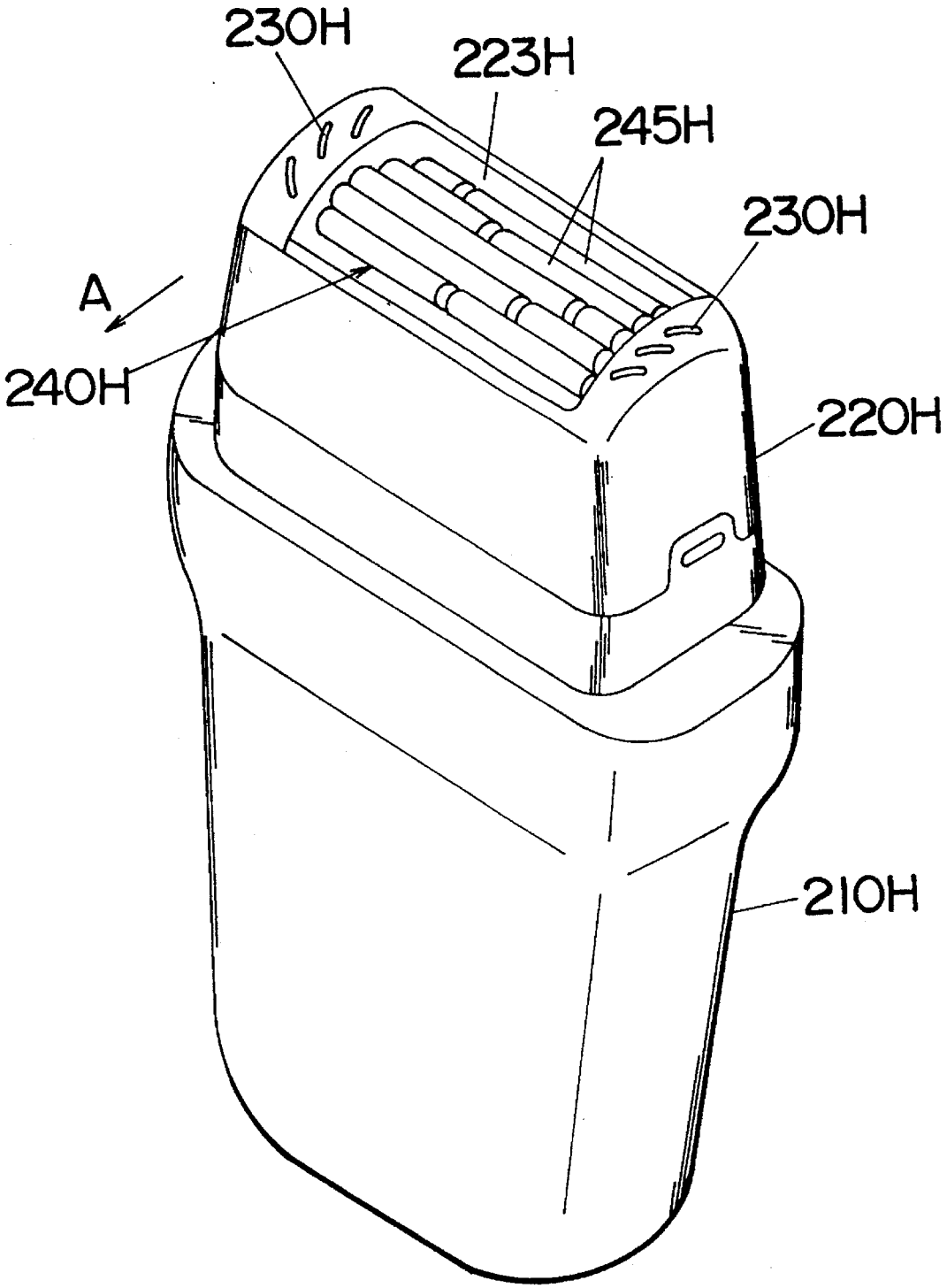
FIG. 39 is a perspective view of a depilating device in accordance with a modification of the above embodiment.

As shown in FIG. 39, the stretcher ribs 230H may be formed only on top of the head frame 220H and not on the plucking head 240H which comprises like rods 245H operating in the same manner as in the previous embodiment for plucking the hairs. In this modification, plural pairs of inclined stretcher ribs 230H are disposed longitudinally outwardly of the rods 245H in a symmetrical relation with respect to the advancing direction A of the housing 210H for stretching the skin sidewards as the head frame 220H is moved in contact with the skin in the advancing direction A.

What is claimed is:

1. A depilating device for removing hairs from the skin of a user, comprising:

a housing with a top opening;

a plucking head disposed adjacent said top opening, said plucking head carrying a series of adjacent pinching elements arranged in side-by-side relationship to form gaps therebetween, wherein at least one of the pinching elements is movable relative to another of the pinching elements in a direction of successive opening and closing of said gaps to entrap and pinch the hairs between said adjacent pinching elements for plucking the hairs from the skin, said plucking head being configured to expose pinching ends of said pinching elements in said opening;

an electric motor incorporated within said housing and connected through a drive mechanism to drive said plucking head for plucking the hairs;

a skin guide disposed at a periphery of said plucking head within said opening to be exposed at least partially beyond said pinching elements for contact with and stretching of the skin, wherein said plucking head and said skin guide are coupled to each other and are floatingly supported together on said housing such that they are configured to be depressed, the same together into the housing within a predetermined extent.

2. A depilating device as set forth in claim 1, wherein said plucking head is mounted together with said skin guide, said motor, and said driving mechanism to a chassis which is accommodated within said housing and is floatingly supported thereto by spring means.

3. A depilating device as set forth in claim 1, wherein said skin guide comprises a stretcher rib configured to engage the skin for stretching the skin during manipulation of the device to advance said skin guide in one direction in contact with the skin.

4. A depilating device as set forth in claim 1, wherein said plucking head has a longitudinal axis along which said pinching elements are arranged, and wherein said skin guide is pivotable relative to said housing about a pivot axis extending in parallel with said longitudinal axis of the plucking head.

5. A depilating device as set forth in claim 1, wherein a plurality of skin guides are spaced along a longitudinal axis in an adjacent relation longitudinally outwardly of opposed ends of said plucking head, said skin guides joining into a unitary structure.

6. A depilating device as set forth in claim 1, wherein said skin guide is in the form of a generally rectangular frame having a pair of opposed end bars and a pair of opposed side bars, said end bars located longitudinally outwardly of said plucking head and said side bars located transversely outwardly of said plucking head, one of said pair the pair of opposed projecting from an upper general plane of said frame towards the skin by a greater amount than the other pair.

7. A depilating device as set forth in claim 6, wherein said pair of the opposed end bars project by a greater amount than said pair of the opposed side bars.

8. A depilating device as set forth in claim 6, wherein said pair of the opposed end bars project by a greater amount than said pair of the oppose side bars, and wherein said side bars are aligned along an advancing direction of said housing with said plucking head facing the skin, said advancing direction being defined to be generally perpendicular to an axis along which said pinching elements are arranged.

9. A depilating device as set forth in claim 6, wherein said opposed end and side bars project outwardly from the pinching ends of said pinching elements.

10. A depilating device for removing hairs from the skin of a user, comprising:

a housing with a top opening;

a plucking head attached to said housing and disposed adjacent said top opening, said plucking head carrying a series of adjacent pinching elements arranged in side-by-side relationship to form gaps therebetween, wherein at least one of the pinching elements is movable relative to another of the pinching elements in a direction of successive opening and closing of said gaps to entrap and pinch the hairs between said adjacent pinching elements for plucking the hairs from the skin, said plucking head being configured to expose pinching ends of said pinching elements in said opening, said plucking head disposed to expose said pinching ends of said pinching elements in said opening and configured to move said pinching ends in an advancing direction along which said housing is manipulated in a facing relation with the skin for depilating the hairs therefrom, said advancing direction being defined to be generally perpendicular to an axis along which said pinching elements are arranged;

said housing having a skin guide which is disposed at a periphery of said opening for sliding contact with and stretching of the skin, wherein said skin guide comprises at least one elongated stretcher rib which is inclined with respect to said advancing direction and disposed longitudinally outwardly of said plucking head such that a distance between said stretcher rib and an adjacent pinching element becomes smaller towards said advancing direction.

11. A depilating device as set forth in claim 10, wherein said skin guide comprises at least one pair of opposed elongated stretcher ribs spaced in a direction perpendicular to said advancing direction and disposed symmetrically with respect to said advancing direction such that a distance between the opposed stretcher ribs becomes smaller along said advancing direction.

12. A depilating device for removing hairs from the skin of a user, comprising:

a housing with a top opening;

a plucking head attached to said housing and disposed adjacent said top opening, said plucking head carrying a series of adjacent pinching elements arranged in side-by-side relationship to form gaps therebetween, wherein at least one of the pinching elements is movable relative to another of the pinching elements in a direction of successive opening and closing of said gaps to entrap and pinch the hairs between said adjacent pinching elements for plucking the hairs from the skin, said plucking head being configured to expose pinching ends of said pinching elements in said opening, said plucking head and configured to move said pinching ends in an advancing direction along which said housing is manipulated in a facing relation with the skin for depilating the hairs therefrom, said advancing direction being defined to be generally perpendicular to an axis along which said pinching elements are arranged;

said housing having a skin guide which is disposed at a periphery of said opening for sliding contact with and lateral and forward stretching of the skin;

wherein said skin guide comprises a front stretcher rib located at a forward position of said opening with respect to said advancing direction, and a pair of wing stretcher ribs spaced across said opening along a direction perpendicular to said advancing direction and located rearwardly of said front stretcher rib with respect to said advancing direction.

13. A depilating device as set forth in claim 10 or 12, wherein said housing includes a skin guide roller located behind said opening with respect to said advancing direction for rolling contact with the skin.

14. A depilating device for removing hairs from the skin of a user, comprising:

a housing with a top opening;

a plucking head attached to said housing and disposed adjacent said top opening, said plucking head carrying a series of adjacent pinching elements arranged in side-by-side relationship to form gaps therebetween, wherein at least one of the pinching elements is movable relative to another of the pinching elements in a direction of successive opening and closing of said gaps to entrap and pinch the hairs between said adjacent pinching elements for plucking the hairs from the skin, said plucking head being configured to expose pinching ends of said pinching elements in said opening and to move said pinching ends in an advancing direction along which said housing is manipulated in a facing relation with the skin for depilating the hairs therefrom, said advancing direction being defined to be generally perpendicular to an axis along which said pinching elements are arranged;

a skin guide disposed in said opening adjacent said plucking head for sliding contact with and stretching of the skin, wherein said skin guide comprises at least one elongated stretcher rib which is inclined with respect to said advancing direction, said stretcher rib being driven to move relative to said housing in such a manner as to vary a distance between said stretcher rib and the adjacent pinching element along a direction perpendicular to said advancing direction.

15. A depilating device as set forth in claim 14, wherein said stretcher rib is driven to move relative to said plucking head.

16. A depilating device as set forth in claim 14, wherein said plucking head has a longitudinal axis along which said pinching elements are arranged and wherein said stretcher rib is disposed longitudinally outwardly of said plucking head, said stretcher rib extending spirally around an axis parallel to the longitudinal axis of the plucking head.

17. A depilating device as set forth in claim 14, wherein said plucking head has a longitudinal axis along which said pinching elements are arranged and wherein said stretcher rib is formed as a tooth of a helical gear which is driven to rotate about an axis parallel to the longitudinal axis of said plucking head.

18. A depilating device as set forth in claim 14, wherein said plucking head has a longitudinal axis along which said pinching elements are arranged and wherein said stretcher rib is formed on an endless belt which is driven to rotate about an axis parallel to the longitudinal axis of said plucking head.

19. A depilating device as set forth in claim 14 or 15, said plucking head has a longitudinal axis along which said pinching elements are arranged and wherein said plucking head is driven to move about the longitudinal axis thereof, said stretcher rib being driven to move in a same direction as said plucking head.

20. A depilating device as set forth in claim 14, wherein said stretcher rib is driven to move together with said plucking head relative to said housing.

21. A depilating device as set forth in claim 15, wherein said plucking head has a longitudinal axis along which said pinching elements are arranged and wherein said plucking head is driven to move about the longitudinal axis thereof, said stretcher rib being driven to move in the opposite direction to that of said plucking head.

22. A depilating device for removing hairs from the skin of a user, comprising:

a housing with a top opening;

a plucking head attached to said housing and disposed adjacent said top opening, said plucking head carrying a series of adjacent pinching elements arranged in side-by-side relationship to form gaps therebetween, wherein at least one of the pinching elements is movable relative to another of the pinching elements in a direction of successively opening and closing of said gaps to entrap and pinch the hairs between said adjacent pinching elements for plucking the hairs from the skin, said plucking head configured to expose pinching ends of said pinching elements in said opening and to move said pinching ends in an advancing direction along which said housing is manipulated in a facing relation with the skin for depilating the hairs therefrom, said advancing direction being defined to be generally perpendicular to an axis along which said pinching elements are arranged;

a skin guide disposed in said opening for sliding contact with and stretching of the skin, wherein said skin guide is coupled to said at least one movable pinching element to be movable together therewith and comprises at least one elongated stretcher rib which is inclined with respect to said advancing direction of said housing.

23. A depilating device as set forth in claim 22, wherein said plucking head has a longitudinal axis along which said pinching elements are arranged and wherein said movable pinching element is in the form of a rod extending along an axis parallel to said longitudinal axis, said rod formed integrally with said stretcher rib, said plucking head having a pair of said movable pinching elements arranged in an adjacent relation along said longitudinal axis for moving the adjacent pinching elements towards and away from each other.

24. A depilating device as set forth in claim 23, wherein a plurality of pair of movable pinching elements are spaced circumferentially about said longitudinal axis of said plucking head, said plucking head being driven to rotate about said longitudinal axis to bring the movable pinching elements successively into engagement with the skin for plucking the hairs in such a manner that, when each pair of the pinching elements rotate about said longitudinal axis to come into engagement with the skin, said pinching elements are displaced axially towards each other to close the gap therebetween, and one of said pair of the pinching elements rotate further in the same direction for a limited angular range with the gap kept closed.

25. A depilating device as set forth in claim 23, wherein each of the movable pinching elements are formed with a said stretcher rib which together are inclined in opposite directions with respect to each other.

26. A depilating device as set forth in claim 25, wherein said stretcher ribs are spaced along said longitudinal axis to have a maximum distance M therealong between first ends of said stretcher ribs and have a minimum distance L along said longitudinal axis between second ends of said stretcher ribs, wherein a difference between the maximum distance M and the minimum distance L is selected to be greater than a gap length formed between the adjacent pinching elements when moved away from each other by a maximum extent along said longitudinal axis.

27. A depilating device as set forth in any one of claims 3, 10, 12, 14, and 22, wherein each said stretcher rib is made of an elastic material.

* * * * *